US007761040B2

(12) United States Patent
Uetake et al.

(10) Patent No.: US 7,761,040 B2
(45) Date of Patent: Jul. 20, 2010

(54) IMAGE FORMING APPARATUS HAVING DEVELOPER WITH OPPOSITE POLARITY PARTICLES

(75) Inventors: Shigeo Uetake, Takatsuki (JP); Toshiya Natsuhara, Takarazuka (JP); Junya Hirayama, Takarazuka (JP); Masahiko Matsuura, Suita (JP); Takeshi Maeyama, Kawanishi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 347 days.

(21) Appl. No.: 11/805,815

(22) Filed: May 24, 2007

(65) Prior Publication Data

US 2007/0280738 A1 Dec. 6, 2007

(30) Foreign Application Priority Data

May 31, 2006 (JP) ..... 2006-151422
Jun. 6, 2006 (JP) ..... 2006-157013

(51) Int. Cl.
*G03G 15/09* (2006.01)

(52) U.S. Cl. ..... 399/272; 399/253; 399/270; 399/273

(58) Field of Classification Search ..... 399/264, 399/265, 270, 272, 277, 253, 267, 273, 274
See application file for complete search history.

(56) References Cited

U.S. PATENT DOCUMENTS

| | | | | |
|---|---|---|---|---|
| 4,639,115 | A | 1/1987 | Lin | |
| 5,231,458 | A | 7/1993 | Nishimura | |
| 5,391,455 | A | 2/1995 | Bigelow | |
| 5,506,372 | A * | 4/1996 | Guth et al. | 399/254 |
| 5,802,430 | A | 9/1998 | Wada | |
| 5,991,587 | A | 11/1999 | Kikuchi | |
| 6,463,245 | B1 * | 10/2002 | Suwa et al. | 399/274 |
| 6,512,909 | B2 | 1/2003 | Ozawa | |
| 6,721,516 | B2 | 4/2004 | Aoki et al. | |
| 2004/0228661 | A1 | 11/2004 | Fujishima et al. | |
| 2007/0092306 | A1 | 4/2007 | Matsuura et al. | |

FOREIGN PATENT DOCUMENTS

| | | |
|---|---|---|
| EP | 654 714 A | 1/1994 |
| EP | 0 772 097 A2 | 5/1997 |
| EP | 1 324 149 A2 | 7/2003 |

(Continued)

OTHER PUBLICATIONS

Partial European Search Report dated Dec. 8, 1996 issued in EP Patent Application No. EP 06019262.

(Continued)

*Primary Examiner*—Hoang Ngo
(74) *Attorney, Agent, or Firm*—Brinks Hofer Gilson & Lione

(57) ABSTRACT

A developing unit using a two-component developer intended to provide an image forming apparatus capable of forming a high-quality image for a long period of time. A developing unit using a developer contains toner, carrier and opposite polarity particles having a polarity opposite to the charging polarity of toner includes separation means for separating the toner or opposite polarity particles, and control mechanism for controlling opposite polarity particle separation ratio in response to the image area ratio and the number of prints.

35 Claims, 8 Drawing Sheets

FOREIGN PATENT DOCUMENTS

| | | |
|---|---|---|
| JP | 59-100471 | 6/1984 |
| JP | 06-295123 | 10/1994 |
| JP | 09-185247 | 7/1997 |
| JP | 2000-298396 | 10/2000 |
| JP | 2002-108104 | 4/2002 |
| JP | 2003-057882 | 2/2003 |
| JP | 2003-215855 | 7/2003 |
| JP | 2005-189708 | 4/2005 |

OTHER PUBLICATIONS

Partial European Search Report dated May 9, 2007 issued in EP Patent Application No. EP 06019262.

Non-final Office Action dated Apr. 3, 2009 issued in related application, U.S. Appl. No. 11/519,597.

Final Office Action dated Nov. 10, 2009 issued in related application, U.S. Appl. No. 11/519,597.

Non-final Office Action dated Jan. 29, 2010 issued in related application, U.S. Appl. No. 11/712,107.

Non-final Office Action dated Apr. 15, 2009 issued in related application, U.S. Appl. No. 11/584,891.

Final Office Action dated Nov. 10, 2009 issued in related U.S. Appl. No. 11/584,891.

* cited by examiner

IMAGE FORMING APPARATUS HAVING DEVELOPER WITH OPPOSITE POLARITY PARTICLES

This application is based on Japanese Patent Application No. 2006-151422 filed on May 31, 2006, and No. 2006-157013 filed on Jun. 6, 2006, in Japanese Patent Office, the entire content of which is hereby incorporated by reference.

TECHNICAL FIELD

The present invention relates to an image forming apparatus equipped with a developing unit for developing a latent image on an image carrier using a developer containing toner and a carrier.

BACKGROUND

Regarding image forming apparatus based on electrophotographic technology, following two systems have been known; one is a one-component developing system wherein only toner is employed as a developer for developing an electrostatic latent image formed on the image carrier, and the other is a two-component developing system wherein toner and carrier are used.

The one-component developing system generally uses a toner supporting member and a regulating plate pressed against the toner supporting member. While the toner on the toner supporting member is pressed by the regulating plate, film thickness is regulated, whereby forming a toner thin layer having a predetermined amount of electrostatic charge. The electrostatic latent image on the image carrier is developed by this toner thin layer. This system is characterized by excellent dot reproducibility, and easily provides a uniform image with the minimum irregularity. This system is also considered to simplify and downsize the apparatus, and to reduce the costs. However, a heavy stress is applied to the toner by the regulating section. This may degenerate the toner surface. Further, toner or external additive may stick to a toner regulating member and the toner supporting member surface, or may reduce the electrostatic charge of the toner. Fogging on the image due to poorly charged toner or internal contamination due to scattering with those toner will occur, with the result that the service life of the developing unit is reduced.

In the two-component developing system, electrostatic charge is caused by turiboelectric charging resulting from mixture of toner and carrier. This reduces stress and deterioration of toner. Due to its large surface area, the carrier that causes electrostatic charge of toner is relatively resistant to the contamination by toner or external additive, and hence, ensures a longer service life.

However, even when the two-component developer is used, carrier surface is contaminated by toner or external additive all the same. The electrostatic charge of toner will be reduced by a long-term use, and the problems involving fogging or scattering of toner will arise. Thus, the service life cannot be said to be sufficient. Some means must be provided to ensure longer service life.

In an effort to prolong the service life of the two-component developer, a developing unit is disclosed in the Unexamined Japanese Patent Application Publication No. S59-100471, wherein a carrier, together with toner or independently, is replenished little by little, and the developer of deteriorated electrostatic charge is ejected accordingly. The carrier is replaced, whereby the percentage of the deteriorated carrier is reduced. Through replacement of carrier, this device ensures that reduction in the electrostatic charge of toner due to deterioration of the carrier is kept to a predetermined level. This arrangement contributes to a longer service life.

Unexamined Japanese Patent Application Publication No. 2003-215855 discloses a two-component developer made up of the toner provided with external addition of the particles having a polarity of electrostatic charge reverse to that of the toner, and a carrier. The particles having reverse polarity in the development method based thereon serve as abrasive powder and spacer particles, and are effective in removing spent matters from the carrier surface. Accordingly, it has an advantage of reducing the possible deterioration of the carrier.

Unexamined Japanese Patent Application Publication No. H9-185247 discloses so called hybrid development method for developing a latent image on the image carrier by using the toner supporting member that supports only the toner from the two-component developer. The hybrid development method provides excellent dot reproducibility and image uniformity without a brush mark of the image being caused by a magnetic brush. Further, due to lack of direct contact between the image carrier and the magnetic brush, this method causes no transfer of the carrier to the carrier (consumption of carrier). This is an advantage that cannot be found in the conventional two-component developing systems. In the hybrid development method, toner is charged by triboelectric charging with the carrier. Accordingly, keeping of the charge applying property of the carrier is important for stabilizing the electrostatic charge of the toner and ensuring a long-term maintenance of image quality.

However, according to the Unexamined Japanese Patent Application Publication No. S59-100471, such problems as cost and environmental issues arise since a mechanism for collecting the ejected carrier, or the carrier gets to belong to consumable supplies. Further, printing of a predetermined number of sheets must be completed before the radio of a new carrier to the old is stabilized, and the initial characteristics cannot always be maintained. Moreover, the Unexamined Japanese Patent Application Publications Nos. 2003-215855 and H9-185247 involve the problem wherein, with the increase in the number of prints, the carrier surface is contaminated by toner or finishing agents, with the result that the charge-applying property of the toner is reduced.

SUMMARY

The object of the present invention is to solve the aforementioned problems and to provide an image forming apparatus capable of providing excellent image formation for a long time, using a two-component developer. In view of forgoing, one embodiment according to one aspect of the present invention is an image forming apparatus, comprising:

an image carrier:

an image forming mechanism which is adapted to form an electrostatic latent image on the image carrier; and a developing unit which is disposed facing the image carrier in a development area and is adapted to develop the electrostatic latent image formed on the image carrier, wherein the developing unit includes:

- a developer tank which is adapted to store developer including toner, carrier for charging the toner and opposite polarity particles which are to be charged to an opposite polarity to a polarity of electrostatic charge of the toner;
- a conveyance mechanism which is adapted to convey the toner to the development area and to collect the opposite polarity particles back into the developer tank; and a control mechanism which is adapted to control an amount of the opposite polarity particles collected back into the developer tank.

According to another aspect of the present invention, another embodiment is an image forming apparatus, comprising:

an image carrier:

an image forming mechanism which is adapted to form an electrostatic latent image on the image carrier; and a developing unit which is disposed facing the image carrier in a development area and is adapted to develop the electrostatic latent image formed on the image carrier, wherein the developing unit includes:

a developer tank which is adapted to store developer including toner, carrier for charging the toner and opposite polarity particles which are to be charged to an opposite polarity to a polarity of electrostatic charge of the toner;

a conveyance mechanism which is adapted to convey the toner to the development area and to collect the opposite polarity particles back into the developer tank; and a control mechanism which is adapted to calculate an image area ratio which is a ratio of an area to which toner is attached to an area of a whole image, and to control an amount of the opposite polarity particles collected back into the developer tank depending on the image area ratio.

According to another aspect of the present invention, another embodiment is an image forming apparatus, comprising:

an image carrier:

an image forming mechanism which is adapted to form an electrostatic latent image on the image carrier; and a developing unit which is disposed facing the image carrier in a development area and is adapted to develop the electrostatic latent image formed on the image carrier, wherein the developing unit includes:

a developer tank which is adapted to store developer including toner, carrier for charging the toner and opposite polarity particles which are to be charged to an opposite polarity to a polarity of electrostatic charge of the toner;

a conveyance mechanism which is adapted to convey the toner to the development area and to collect the opposite polarity particles back into the developer tank;

a counter for counting an accumulated number of image forming; and a control mechanism which is adapted to increase an amount of the opposite polarity particles to be collected back into the developer tank depending on an increase of the accumulated number counted by the counter.

DETAILED DESCRIPTION OF THE PREFERRED EMBODIMENT

Figure 1:
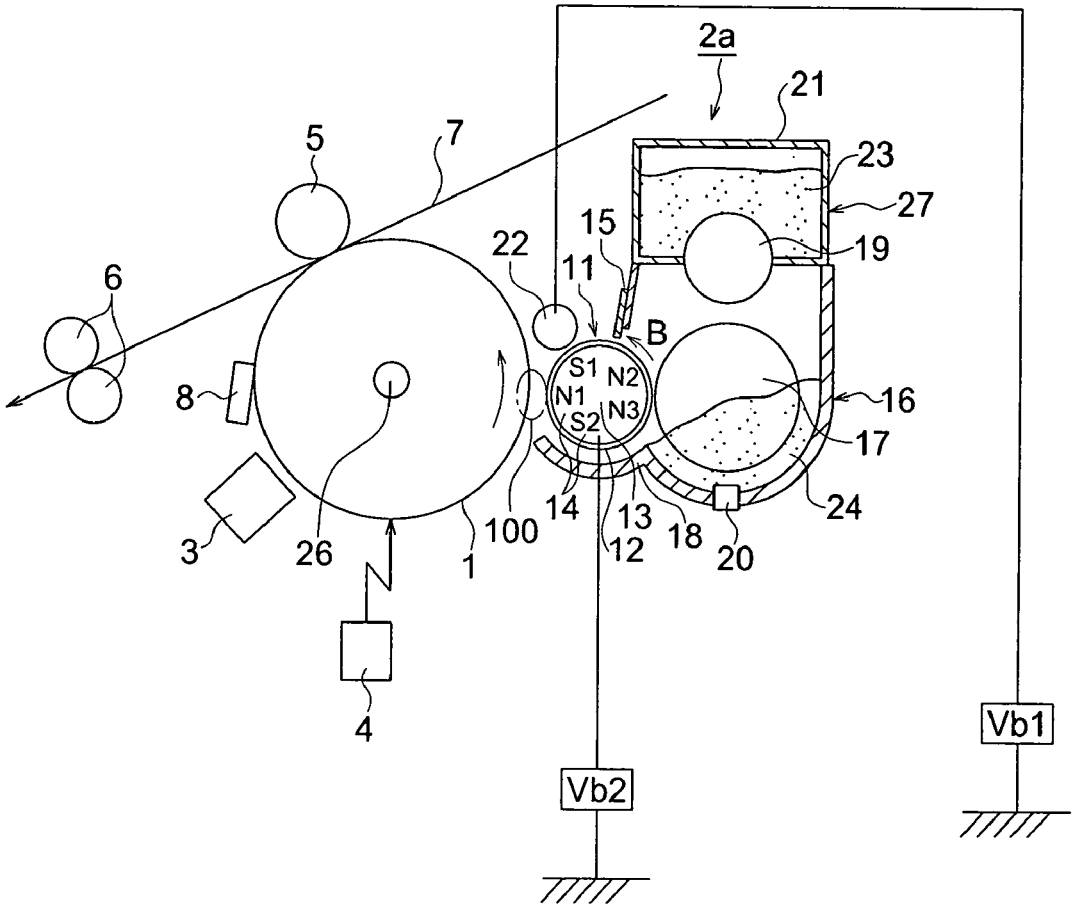
FIG. 1 is a schematic diagram representing an image forming apparatus as a first and a third embodiments of the present invention.

Referring to the drawings, the following specifically describes the details of the embodiments preferable to the present invention. It is to be expressly understood, however, that the present invention is not restricted to the dimensions, material, shape and relative arrangement of the component parts described in the embodiment, unless otherwise specified. In the present Specification, the "image" and "entire image" refer to the entire image including the "image portion" and "background portion". The "image portion" indicates the portion of the "image" to which toner is to be attached. The "background portion" denotes the portion of the "image" to which toner is not attached. The "image area ratio" refers to the percentage of the "image portion" with respect to the "entire image".

The first and the second embodiments employ a control mechanism wherein the percentage of separating the opposite polarity particles by the separation section is controlled depending on the image area ratio of the image portion with respect to the entire image.

First Embodiment

FIG. 1 is a-cross sectional view of an image forming apparatus as a first embodiment of the present invention. As shown in FIG. 1, a charging unit 3, laser exposure optical system 4, which is an image forming mechanism for forming an electrostatic latent image, developing unit 2*a*, cleaner 8, and transfer unit 5 are arranged around the image carrier (photoreceptor) 1. The image forming process using this image forming apparatus is applied as follows: The surface of the photoreceptor 1 is electrostatically charged by the charging unit 3 uniformly. Then the image exposure step is taken by the laser exposure optical system 4 and an electrostatic latent image is formed. This latent image is developed by the developing unit 2*a* using toner, and the toner image having been developed is transferred onto the transfer paper 7 by means of a transfer unit. The toner image on the transfer paper 7 is fixed on the transfer paper by a fixing unit 6. The toner remaining on the photoreceptor 1 subsequent to transfer is removed by a cleaner 8. The surface of the photoreceptor 1 having been cleaned is again subjected to the image forming process.

The photoreceptor 1 uses a rotary shaft 26 to rotatably support the drum-shaped substrate made of a conductive material such as aluminum, and a photoconductive layer made of OPC or the like is formed on the surface of the substrate. The substrate is grounded through a rotary shaft 26, and the photoreceptor 1 rotates in the arrow-marked direction.

A corona charging unit using a discharge wire, a contact type charging unit that uses a conductive roller, conductive brush, conductive particles or the like, or needle type charging unit using a sawtooth-shaped electrode can be used as the charging unit 3.

(Structure of Developing Unit 2*a*)

The following describes the details of the structure of the developing unit 2*a:*

The developing unit 2*a* of the present embodiment contains a developer tank 16 containing developer 24 including toner, carrier and opposite polarity particles of a polarity opposite to that of the toner; a developer supporting member 11 for conveyance by supporting the developer 24 supplied from the developer tank 16 on its surface; and a separation section for separating the opposite polarity particles from the developer on the developer supporting member 11. The separation section has a opposite polarity particle separating member 22 as a separating member for separating the opposite polarity particles; and a power source Vb1 as an electric field forming mechanism for applying bias voltage to the opposite polarity particle separating member 22 for separating the opposite polarity particles from the developer supporting member 11. This opposite polarity particle separating member 22 is provided upstream from the development area 100 on the developer supporting member 11 in the traveling direction of the developer. The opposite polarity particles are separated from the developer on the aforementioned developer supporting member 11 before the developer on the developer supporting member 11 develops the electrostatic latent image on the image carrier 1. The output voltage of the power source Vb1 is controlled depending on the image area ratio of the image portion to the entire image, and the controlled voltage is used to control the separation ratio of the opposite polarity particles from the developer on the developer supporting member 11. The opposite polarity particles on the opposite polarity particle separating member 22 having been separated and captured from the developer supporting member 11 are transferred to the side of the developer supporting member 11 by switching the output voltage of the power source Vb1 between the printings of images, whereby these particles are collected back into the developer tank 16. The developer supporting member 11, the opposite polarity particle separating member 22 and the power source Vb1 correspond to the conveyance mechanism of the present invention.

As described above, the number of the opposite polarity particles to be transferred to the image carrier 1 is reduced by separating the opposite polarity particles prior to development. At the same time, the separation ratio is controlled depending on the image area ratio, and hence, the optimum amount can be collected back into the developer tank 16, independently of the magnitude of the image area ratio. Thus, deterioration of the charge applying property of the carrier resulting from accumulation of print volume is compensated for by the opposite polarity particles, thereby preventing reduction in the amount of electrostatic static charge of toner. This arrangement provides an image forming apparatus capable of forming images stabilized for a long time.

(Separation Voltage Control)

Figure 2:
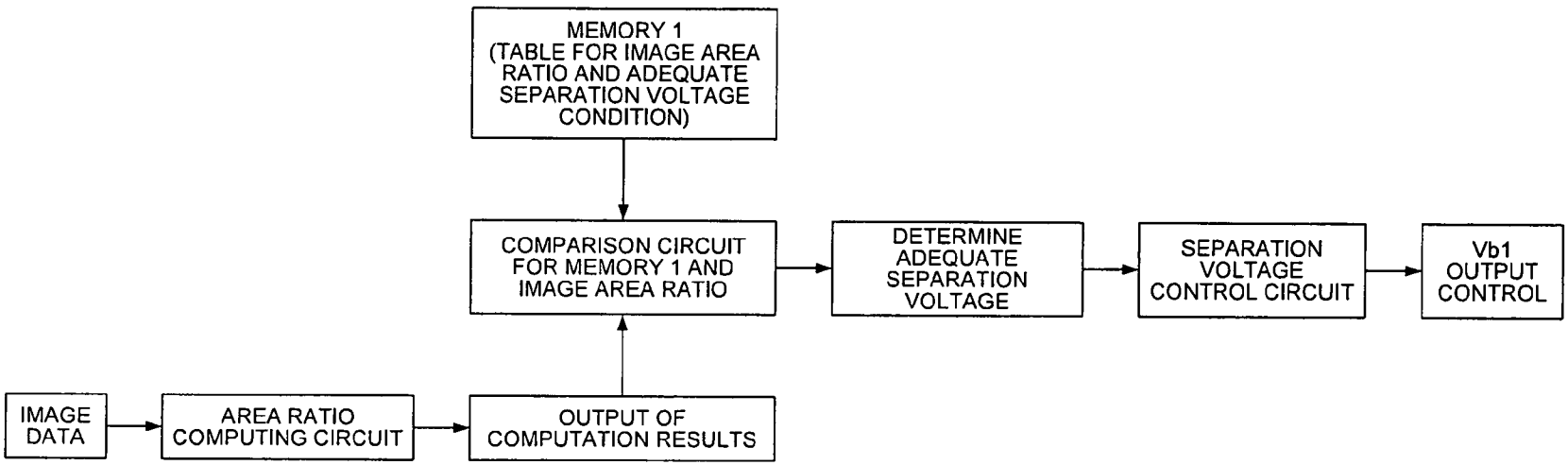
FIG. 2 is a flowchart for controlling the separation voltage depending on the image area ratio as the first embodiment of the present invention.

The following describes the method of controlling the separation voltage depending on the image area ratio. FIG. 2 is a flowchart for controlling the separation voltage. In the first place, an adequate separation voltage conditions for various image area ratios are determined in advance. These separation voltage conditions provide the utmost stabilization to the amount of electrostatic charge of toner when images of a certain image area ratio are printed continuously. The amount of the opposite polarity particles stored in the developer tank 16 is stabilized to the optimum level by selecting the separation voltage condition corresponding to the area ratio of the image to be printed, and controlling the amount of separation of the opposite polarity particles. Such a correspondence table between the image area ratios and adequate separation voltage conditions is created, and is stored in the memory.

The image area ratio is computed from the image data in response to the print instruction. An adequate separation voltage condition is selected from the image area ratio as a result of this computation and the correspondence table, and the bias voltage for separating the opposite polarity particles is outputted to the opposite polarity particle separating member 22 from the power source Vb1, thereby controlling the separation ratio for separating the opposite polarity particles from the developer supporting member 11. It is also possible to make a use of a mechanism wherein the separation ratio of the opposite polarity particles is controlled by changing the distance between the opposite polarity particle separating member 22 and developer supporting member 11. By changing the distance between the opposite polarity particle separating member 22 and developer supporting member 11, the density of the developer is changed while the intensity of the electric field working between the two is changed. This ensures more preferable control of the separation ratio.

To control the separation ratio depending on the image area ratio, the separation voltage condition may be selected for every individual sheet, as described above. It is also possible to control the ratio for every predetermined number of sheets.

The image area ratio can be computed based on the image data, as described above. It can also be computed from the amount of the toner supplied from the toner supply mechanism in response to the amount of the toner consumed. In this case, it is also possible to compute the average image area ratio from the integrated value for the amount of the toner having been supplied so far and the number of prints, and to determine the separation voltage condition based on the result of this computation. For example, the amount of the toner supplied for each ten sheets is detected, and this amount of supply is divided by ten, thereby computing the average image area ratio. The amount of the opposite polarity particles in the developer tank 16 is estimated from the result of this computation. The adequate amount of the opposite polarity particles corresponding to the degree of deterioration of the carrier depending on the number of prints is compared with the estimated amount of the opposite polarity particles in the developer tank 16, thereby determining the separation voltage condition for controlling the separation ratio of opposite polarity particles so that the amount of the opposite polarity particles in the developer tank 16 is adequate.

(Developer)

In the embodiment, the developer 24 contains toner, a carrier for electrostatically charging the toner, and opposite polarity particles. The opposite polarity particles can be charged by the carrier to have a polarity of the electrostatic charge opposite to that of the toner. For example, when the toner is negatively charged by the carrier, the opposite polarity particles are positively charged in the developer. Further, for example, when the toner is positively charged by the carrier, opposite polarity particles are negatively charged in the developer. The two-component developer is mixed with opposite polarity particles, the separation section is used so that opposite polarity particles in the developer are accumulated with an increase in the number of prints, and even if there is a decrease in the charge applying property of the carrier caused by the spent matters of the toner and finishing agent, the reduction in the charge applying property of the carrier can be compensated for, since the opposite polarity particles 4 are capable of positively charging the toner, with the result that deterioration of the carrier can be prevented.

The opposite polarity particles preferably used are adequately selected according to the charging polarity of the toner. When a negatively charging toner is used, the positively charging particles are employed as the opposite polarity particles. They are exemplified by inorganic particles such as strontium titanate, barium titanate and alumina, and thermoplastic or thermosetting resins such as acryl resin, benzoguanamine resin, nylon resin, polyimide resin and polyamide. Further, a positive charge control agent having positive charging property can be included in the resin, or a copolymer of nitrogen-containing monomer can be formed. In this case, nigrosine dye and quaternary ammonium salt, for example, can be used as the aforementioned positive charge control agent. The aforementioned nitrogen-containing monomer is exemplified by 2-dimetylaminoethyl acrylate, 2-diethylaminoethyl acrylate, 2-dimetylaminoethyl methacrylate, 2-diethylaminoethyl methacrylate, vinylpyridine, N-vinylcarbazole and vinylimidazole.

When the positively charging toner is utilized, negatively charging particles are used as opposite polarity particles. For example, it is possible to use the thermoplastic resin or thermosetting resin such as fluorine resin, polyolefin resin, silicone resin and polyester resin, in addition to the inorganic particles such as silica and titanium oxide. It is also possible to contain the resin with the negative charge control agent having a negative charging property, or to form a copolymer of the fluorine-containing acryl based monomer or fluorine-containing methacryl based monomer. In this case, salicylate- or naphthol-based chromium complex, aluminum complex, iron complex and zinc complex, for example, can be used as the aforementioned negative charge control agent.

To regulate the electrostatic charge and hydrophobicity of the opposite polarity particles, the surface of the inorganic particles may be provided with surface treatment using a silane coupling agent, titanium coupling agent, silicone oil or the like. Particularly when inorganic particles are to be positively charged, an amino group-containing coupling agent is preferably used to provide surface treatment. When inorganic particles are to be negatively charged, a fluorine-containing coupling agent is preferably used to provide surface treatment.

The number average particle size of the opposite polarity particles is preferably 100 through 1000 nm.

There is no restriction to the type of toner. A conventionally used toner can be used. A binder resin may be mixed with a coloring agent or electric charge control agent or mold release agent, as required, and may be provided with treatment with external additive. Although there is no restriction to the toner diameter, the toner diameter is preferably about 3 through 15 μm.

Such toner can be manufactured by the conventional method as exemplified by pulverization method, emulsion polymerization method and suspension polymerization method.

Although there is no restriction to the type of the binder resin used for toner, it is possible to use a styrene based resin (polymer or copolymer including the styrene or substitution product for substituted styrene), polyester resin, epoxy resin, polyvinyl chloride resin, phenol resin, polyethylene resin, polypropylene resin, polyurethane resin, silicone resin and others. It is preferred to use these resins independently or as a complex, and it is preferable to use the resins that have a softening temperature of 80 through 160° C. and a glass-transition point of 50 through 75° C.

Further, a conventional coloring agent can be used. It is exemplified by carbon black, aniline black, activated carbon, magnetite, benzine yellow, permanent yellow, naphthol yellow, phthalocyanine blue, first skyblue, ultramarine blue, rose bengal and lake red. Generally, 2 through 20 parts by mass of these agents is preferably used with respect to 100 parts by mass of the aforementioned binder resins.

The conventional agents can also be used as the aforementioned electric charge control agent. The electric charge control agent for positively charging toner is exemplified by nigrosine dye, quaternary ammonium salt compound, triphenyl methane compound, imidazole compound and polyamine resin. The electric charge control agent for negatively charging toner is exemplified by metal-containing azo dye such as Cr, Co, Al and Fe, salicylic acid metal compound, alkyl salicylic acid metal compound and Kerlix arene compound. 0.1 through 10 parts by mass of the electric charge control agent is used with respect to 100 parts by mass of the aforementioned binder resin.

The conventional agent can also be used as the aforementioned mold release agent. Polyethylene, polypropylene, carnauba wax and southall wax can be used independently, or two or more of them can be combined for use. Generally, 0.1 through 10 parts by mass of this agent is preferably used with respect to 100 parts by mass of the aforementioned binder resin.

The conventional agent can also be used as the aforementioned external additive. It is also possible to use the agent of improved flowability as exemplified by such inorganic particles as silica, titanium oxide and aluminum oxide or such resin particles as acryl resin, styrene resin, silicone resin and fluorine resin. Especially the agent made hydrophobic by the silane coupling agent, titanium coupling agent and silicone oil is preferably used. 0.1 through 5 parts by mass of such a superplasticizer is added with respect to 100 parts by mass of the aforementioned toner. The number average primary particle size of the external additive is preferably 10 through 100 nm.

The conventional carrier can also be used as a carrier. It is also possible to use a binder type carrier or coated type carrier. Although there is no restriction to the carrier particle size, the preferred size is 15 through 100 μm.

The binder type carrier is made of magnetic particles dispersed in the binder resin. It is used to stick positively or negatively charging electrostatic particles onto the carrier surface or to provide a surface coating layer. The electrostatic characteristics of the polarity of the binder type carrier can be controlled by the material of the binder resin, electrostatic particles and the type of surface coating layer.

The binder resin used for the binder type carrier is exemplified by such thermoplastic resins as vinyl based resin represented by the polystyrene resin, polyester resin, nylon resin and polyolefin resin, and such thermosetting resins such as phenol resin.

As the magnetic particles of the binder type carrier, it is possible to use magnetite; spinel ferrite such as gamma ferric oxide; spinel ferrite containing one or more metals (Mn, Ni, Mg and Cu) other than iron; magnetoplumbite-type ferrite such as barium ferrite; and the particles of iron or alloy having an oxide layer on the surface. The shape can be granular, spherical or acicular. When a specially high degree of magnetism is required, the iron-based ferromagnetic particles are preferably used. Further, when consideration is given to chemical stability, ferromagnetic particles of magnetoplumbite-type ferrite such as magnetite, spinel ferrite such as gamma ferric oxide and magnetoplumbite-type ferrite such as barium ferrite are preferably used. A magnetic resin carrier having a desired level of magnetism can be obtained by adequate selection of the type and amount of the contained ferromagnetic particles. 50 through 90% by mass of magnetic particles is preferably added to the magnetic resin carrier.

The surface coating material of the binder type carrier is exemplified by silicone resin, acryl resin, epoxy resin and fluorine resin. These resins are coated on the surface to form a coated layer, whereby the charge applying property can be improved.

When the electrostatic particles or conductive particles are made to stick to the surface of the binder type carrier, for example, the magnetic resin carrier and particles are uniformly mixed, and these particles are made to stick to the surface of the magnetic resin carrier. After that, mechanical and thermal impact is applied, and the particles are made to stick by driving particles into the magnetic resin carrier. In this manner, the particles are made to partially protrude from the magnetic resin carrier surface, without being completely embedded into the magnetic resin carrier. Electrostatic particles used are organic and inorganic insulating materials. To put it more specifically, the organic insulating particles that can be used are polystyrene, styrene copolymer, acryl resin, various types of acryl copolymer, nylon, polyethylene, polypropylene, fluorine resin and crosslinked substances thereof. A desired level of electrostatic charge and polarity can be obtained by the type of the material, polymerization catalyst and surface treatment. The inorganic substances to be used are exemplified by negatively charged inorganic particles such as silica and titanium dioxide, and positively charged inorganic particles such as strontium titanate and alumina.

In the meantime, the coating type carrier is the carrier wherein the carrier core particles made up of magnetic substances are coated with resin. Positively or negatively charging electrostatic particles can be made to stick to the surface of the coating type carrier, similarly to the case of the binder type carrier. The electrostatic characteristics such as the polarity of the coating type carrier can be controlled according to the type of the surface coating layer and electrostatic particles. Further, the same material as that of the binder type carrier can be used. Particularly, the coating resin allows use of the same resin as the binder resin of the binder type carrier.

Figure 8:
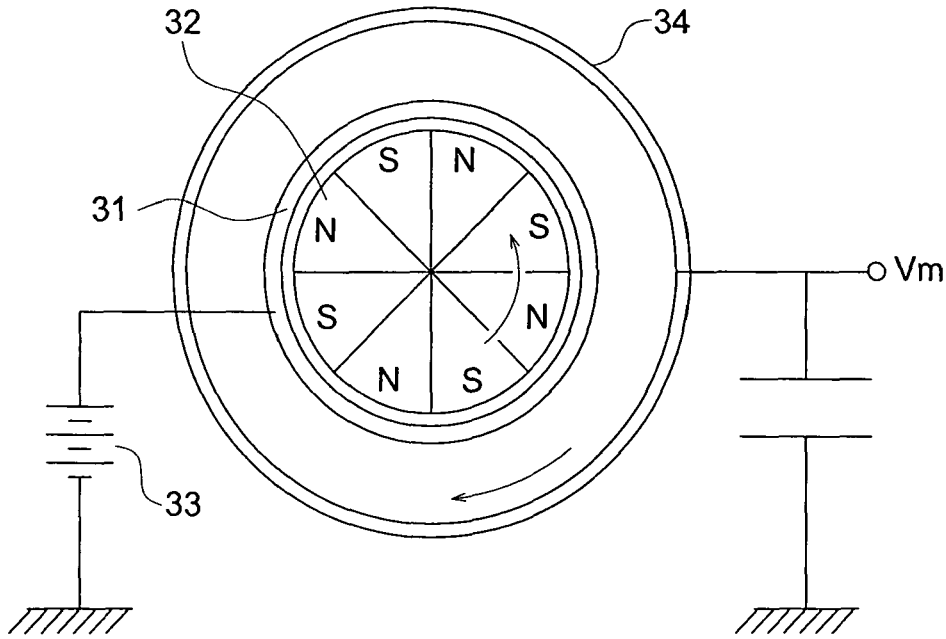
FIG. 8 is a schematic diagram representing an apparatus for measuring the amount of electrostatic static charge.

The electrostatic polarity of the toner and opposite polarity particles in a combination of opposite polarity particles, toner and carrier can be easily identified from the direction of the electric field to separate toner or opposite polarity particles from the developer, subsequent to mixing and agitation of them to form a developer using the apparatus shown in FIG. 8.

It is sufficient if the mixing ratio of the toner to carrier is adjusted so as to get a desired electrostatic charge of toner. The amount of toner is preferably 3 through 50% by mass, more preferably, 6 through 30% by mass with respect to the total amount of the toner and carrier.

There is no restriction to the amount of the opposite polarity particles contained in the developer so long as the object of the present invention can be achieved. It is preferably 0.01 through 5.00 parts by mass, more preferably 0.01 through 2.00 parts by mass with respect to 100 parts by mass of carrier, for example.

The developer can be prepared by mixing the opposite polarity particles externally to the toner in advance and then mixing it with a carrier.

(Separation and Collection)

The following describes the separation and collection of the opposite polarity particles in the developing unit 2*a:*

In the developing unit 2*a*, a opposite polarity particle separating member 22 for collecting the opposite polarity particles by separating them from the developer on the developer supporting member 11 is adopted as a separation section for separating toner or opposite polarity particles from the developer on the developer supporting member 11. As shown in FIG. 1, the opposite polarity particle separating member 22 is provided upstream from the development area 100 on the developer supporting member 11 in the traveling direction of the developer. Upon application of the opposite polarity particle separation bias, the opposite polarity particles in the developer are electrically separated and captured onto the surface of the opposite polarity particle separating member 22. After opposite polarity particles have been separated by the opposite polarity particle separating member 22, the developer remaining on the developer supporting member 11, viz., toner and carrier continue to be conveyed, and the electrostatic latent image on the image carrier 1 is developed in the development area 100.

The opposite polarity particle separating member 22 is connected to the power source Vb1, and opposite polarity particle separation bias controlled depending on the image area ratio is applied, whereby opposite polarity particles in the developer are electrically separated and captured on the surface of the opposite polarity particle separating member 22.

The reversely charged particle separation bias applied to the opposite polarity particle separating member 22 is controlled depending on the image area ratio and is preferably controlled within the following range.

The opposite polarity particle separation bias varies according to the polarity of the electrostatic charge of the opposite polarity particles. To be more specific, it is the voltage that has a lower average value than that of the voltage applied to the developer supporting member 11 when toner is negatively charged and the opposite polarity particles are positively charged. When toner is positively charged and the opposite polarity particles are negatively charged, it has a higher average value than that of the voltage applied to the developer supporting member 11. Regardless of whether the opposite polarity particles are positively or negatively charged, the difference between the average voltage applied to the opposite polarity particle separating member 22 and that applied to the developer supporting member 11 is preferably 20 through 500 V, more preferably 50 through 300 V. If the difference in potential is too small, the opposite polarity particles cannot be collected sufficiently. On the other hand, if the difference in potential is excessive, the carrier held on the developer supporting member 11 by the magnetism is separated by the electric field. Thus, the original development function in the development area 100 may be deteriorated.

In the developing unit 2*a*, an AC electric field is preferably formed between the opposite polarity particle separating member 22 and developer supporting member 11. If the AC electric field has been formed, toner will make a reciprocal motion. This will effectively remove the opposite polarity particles attached to the toner surface, with the result that opposite polarity particles can be recovered more effectively. In this case, an electric field of $2.5\times10^6$ V/m or more is preferably formed. Formation of an electric field of $2.5\times10^6$ V/m or more allows the opposite polarity particles to be separated from toner by the electric field as well. This signifies a further improvement in the separation and collection of the opposite polarity particles.

In the present Specification, the electric field formed between the opposite polarity particle separating member 22 and developer supporting member 11 is referred to as a opposite polarity particle separation electric field. The opposite polarity particle separation electric field is normally obtained by application of AC voltage to the opposite polarity particle separating member 22 and/or developer supporting member 11. Particularly when AC voltage is applied to the developer supporting member 11 for the purpose of developing the electrostatic latent image by toner, it is preferred that the opposite polarity particle separation electric field should be formed using the AC voltage applied to the developer supporting member 11. In this case, the maximum value of the absolute value of the opposite polarity particle separation electric field should be within the aforementioned range.

Assume, for example, that opposite polarity particles are positively charged, the DC voltage and AC voltage are applied to the developer supporting member 11, and DC voltage is applied to the opposite polarity particle separating member 22. In this case, only the DC voltage lower than the average value of the voltage (DC+AC) applied to the developer supporting member 11 is applied to the opposite polarity particle separating member 22. Again assume, for example, that the opposite polarity particles are negatively charged, DC voltage and AC voltage are applied to the developer supporting member 11 and only the DC voltage is applied to the opposite polarity particle separating member 22. In this case, only the DC voltage higher than the average value of the voltage (DC+AC) applied to the developer supporting member 11 is applied to the opposite polarity particle separating member 22. In these cases, the maximum value of the absolute value of the opposite polarity particle separation electric field is the value obtained by dividing the maximum value of the potential difference between the voltage (DC+AC) applied to the developer supporting member 11 and voltage (DC) applied to the opposite polarity particle separating member 22, by the gap of the nearest portion between the opposite polarity particle separating member 22 and developer supporting member 11. This value is preferably located within the aforementioned range.

Again assume, for example, that the opposite polarity particles are positively charged, only the DC voltage is applied to the developer supporting member 11 and AC voltage and DC voltage are applied to the opposite polarity particle separating member 22. In this case, the DC voltage with the AC voltage superimposed thereon so as to get the average voltage lower than the DC voltage applied to the developer supporting member 11 is applied to the opposite polarity particle separating member 22. Again assume, for example, that the opposite polarity particles are negatively charged, only the DC voltage is applied to the developer supporting member 11, and AC voltage and DC voltage are applied to the opposite polarity particle separating member 22. In this case, the DC voltage with the AC voltage superimposed thereon so as to get the average voltage higher than the DC voltage applied to the developer supporting member 11 is applied to the opposite polarity particle separating member 22. In these cases, the maximum value of the absolute value of the opposite polarity particle separation electric field is the value obtained by dividing the maximum value of the potential difference between the voltage (DC) applied to the developer supporting member 11 and voltage (DC+AC) applied to the opposite polarity particle separating member 22, by the gap of the nearest portion between the opposite polarity particle separating member 22 and developer supporting member 11. This value is preferably located within the aforementioned range.

Further assume, for example, that the opposite polarity particles are positively charged, and DC voltage with AC voltage superimposed thereon is applied to both of the developer supporting member 11 and opposite polarity particle separating member 22. In this case, the voltage (DC+AC) wherein the average value is smaller than that of the voltage (DC+AC) applied to the developer supporting member 11 is applied to the opposite polarity particle separating member 22. Further assume, for example, that the opposite polarity particles are negatively charged, and DC voltage with AC voltage superimposed thereon is applied to both of the developer supporting member 11 and opposite polarity particle separating member 22. In this case, the voltage (DC+AC) wherein the average value is greater than that of the voltage (DC+AC) applied to the developer supporting member 11 is applied to the opposite polarity particle separating member 22. In these cases, the maximum value of the absolute value of the opposite polarity particle separation electric field is the value obtained by dividing the maximum value of the potential difference between the voltage (DC+AC) applied to the developer supporting member 11 and voltage (DC+AC) applied to the opposite polarity particle separating member 22 resulting from the differences in the amplitude, phase, frequency and duty cycle of the AC voltage component applied to each, by the gap of the nearest portion between the opposite polarity particle separating member 22 and developer supporting member 11. This value is preferably located within the aforementioned range.

The opposite polarity particles on the surface of the member separated and captured by the opposite polarity particle separating member 22 are collected into the developer tank 16. When the opposite polarity particles are collected into the developer tank from the opposite polarity particle separating member 22, the relationship of magnitude between the average value of the voltage applied to the opposite polarity particle separating member 22 and that of the voltage applied to the developer supporting member 11 should be reversed. This can be done at time intervals, prior to image formation or subsequent to image formation, during non-image forming operation, such as the period between sheets (the period between the previous and succeeding pages), between the image formation operations at the time of continuous operation.

(Component of Developing Unit 2*a*)

The opposite polarity particle separating member 22 may be made of any material so long as the aforementioned voltage can be applied. An aluminum roller provided with surface treatment can be mentioned as an example. The upper surface of the conductive substrate of aluminum or the like may be provided with resin coating such as polyester resin, polycarbonate resin, acryl resin, polyethylene resin, polypropylene resin, urethane resin, polyamide resin, polyimide resin, polysulfone resin, polyether ketone resin, polyvinyl chloride resin, vinyl acetate resin, silicone resin, and fluorine resin; or rubber coating such as silicone rubber, urethane rubber, nitrile rubber, natural rubber and isoprene rubber. The coating material is not restricted thereto. It is also possible to add a conductive agent to the bulk of the aforementioned coating or the surface. An electron conductive agent or ion conductive agent can be mentioned as the conductive agent. The electron conductive agent is exemplified by carbon black such as kechen black, acetylene black and furnace black, or particles of metallic powder and metallic oxide, without being restricted thereto. The ion conductive agent is exemplified by a cationic compound such as quaternary ammonium salt, amphoteric compound, and other ionic high molecular materials, without being restricted thereto. Further, a conductive roller made of metallic material such as aluminum can be used.

The developer supporting member 11 is made up of a magnet roller 13 secured in position, and a rotatably mounted sleeve roller 12 incorporating the same. The magnet roller 13 has five magnetic poles 14 N1, S2, N3, N2 and S1 in the rotating direction "B" of the sleeve roller 12. Of these magnetic poles, the main magnetic pole N1 is positioned in the development area 100 facing the image carrier 1, and magnetic poles N3 and N2 for generating the repulsive magnetic field for separating the developer 24 on the sleeve roller 12 are located in the position face to face with the interior of the developer tank 16.

The developer tank 16 is made of a casing 18, and normally contains a bucket roller 17 for supplying the developer to the developer supporting member 11. An ATDC (Automatic Toner Density Control) sensor 20 for toner density detection is preferably arranged face to face with the bucket roller 17 of the casing 18.

The developing unit 2*a* normally has a toner supply mechanism 27 for supplying the developer tank 16 with the amount of toner to be consumed in the development area 100, and a regulating member 15 for reducing the thickness of the developer layer for regulating the amount of the developer on the developer supporting member 11. The toner supply mechanism 27 is made up of a hopper 21 for storing the supply toner 23, and a supply roller 19 for supplying toner into the developer tank 16.

The toner with the opposite polarity particles externally added thereto is preferably used as the supply toner 23. Use of the toner with the opposite polarity particles externally added thereto provides effective compensation for the reduction of the electrostatic charge of the carrier that is gradually deteriorated by the increasing number of prints. The amount of the opposite polarity particles added externally in the supply toner 23 is preferably 0.1 through 10.0% by mass with respect to the amount of toner, more preferably 0.5 through 5.0% by mass.

(Movement of Developer)

The following describes the movement of the developer in the developing unit 2*a:*

The developer 24 in the developer tank 16 is mixed and stirred by the rotation of the bucket roller 17, and is subjected to triboelectric charging. After that, it is pumped up by the bucket roller 17, and is supplied to the sleeve roller 12 of the developer supporting member 11 surface. This developer 24 is held on the surface side of the sleeve roller 12 by the magnetism of the magnet roller 13 inside the developer supporting member 11, and is moved by rotating with the sleeve roller 12. The amount of passage is regulated by the regulating member 15 arranged face to face with the developer supporting member 11. After that, in the portion opposite the opposite polarity particle separating member 22, only the opposite polarity particles contained in the developer is separated and captured by the opposite polarity particle separating member 22, as described above. The remaining developer from which the opposite polarity particles having been separated is conveyed to the development area 100 located face to face with the image carrier 1. In the development area 100, a bristle of developer is formed by the magnetism of the main magnetic pole N1 of the magnet roller 13, and the toner in the developer is moved toward the electrostatic latent image on the image carrier 1 by the force given to the toner by the electric field formed between the electrostatic latent image on the image carrier 1 and the developer supporting member 11 to which development bias is applied, whereby the electrostatic latent image is developed into a visible image. Either normal development or reversal development method may be used for development. The developer 24 from which the toner have been consumed in the development area 100 is fed toward the developer tank 16, is separated from the top of the developer supporting member 11 by the repulsive magnetic field of the magnetic poles N3 and N2 of the magnetic roller arranged face to face with the bucket roller 17, and is collected back into the developer tank 16. Upon detecting the output value of the ATDC sensor 20 to find out that the toner density in the developer 24 has been reduced below the lowest toner density for ensuring the image density, the supply control section (not illustrated) arranged on the toner supply mechanism 27 sends the drive start signal to the drive section of the toner supply roller 19. Then the rotation of the toner supply roller 19 starts. This rotation causes the supply toner 23 stored in the hopper 21 to be supplied into the developer tank 16. In the meantime, the opposite polarity particles captured by the opposite polarity particle separating member 22 are fed back onto the developer supporting member 11 by reversing the direction of the electric field applied between the developer supporting member 11 and opposite polarity particle separating member 22 during non-image forming operation, and are conveyed together with the developer by rotation of the developer supporting member 11. Then they are fed back to the developer tank.

In FIG. 1, the opposite polarity particle separating member 22 is provided separately from the regulating member 15 and casing 18. However, the opposite polarity particle separating member 22 may serve as either one of the regulating member 15 and casing 18. In other words, the regulating member 15 and/or casing 18 can be used as the opposite polarity particle separating member 22. In this case, the opposite polarity particle separation bias should be applied to the regulating member 15 and casing 18. This procedure saves space and cost.

In the developing unit 2*a*, not all the opposite polarity particles are collected by the opposite polarity particle separating member 22. Some of the opposite polarity particles that have not being collected are fed to the development area together with toner. In the development area, toner and opposite polarity particles are further separated from each other by the operation of the electric field for development. Some of them are not separated and remain sticking on toner. The opposite polarity particles not separated from toner are consumed by the image portion together with the toner. The opposite polarity particles having been separated are consumed by the non-image portion (background portion). Thus, the opposite polarity particle separation ratio depends on the potential of the background portion and the amount of consumption varies accordingly. Further, since electric field for development varies according to a change in the gap of the development area, the opposite polarity particle separation ratio is influenced, and the amount of consumption changes. Thus, the opposite polarity particle separation ratio can be controlled depending on image area ratio through a concurrent use of the background portion potential control section or development gap control section. For example, as the background portion potential control section, the surface potential of the photoreceptor 1 electrostatically charged by the charging unit 3 may be controlled depending on the image area ratio. Further, as the development gap control section, it is also possible to provide a mechanism for controlling the distance between the photoreceptor 1 and developer supporting member 11.

Second Embodiment

Figure 3:
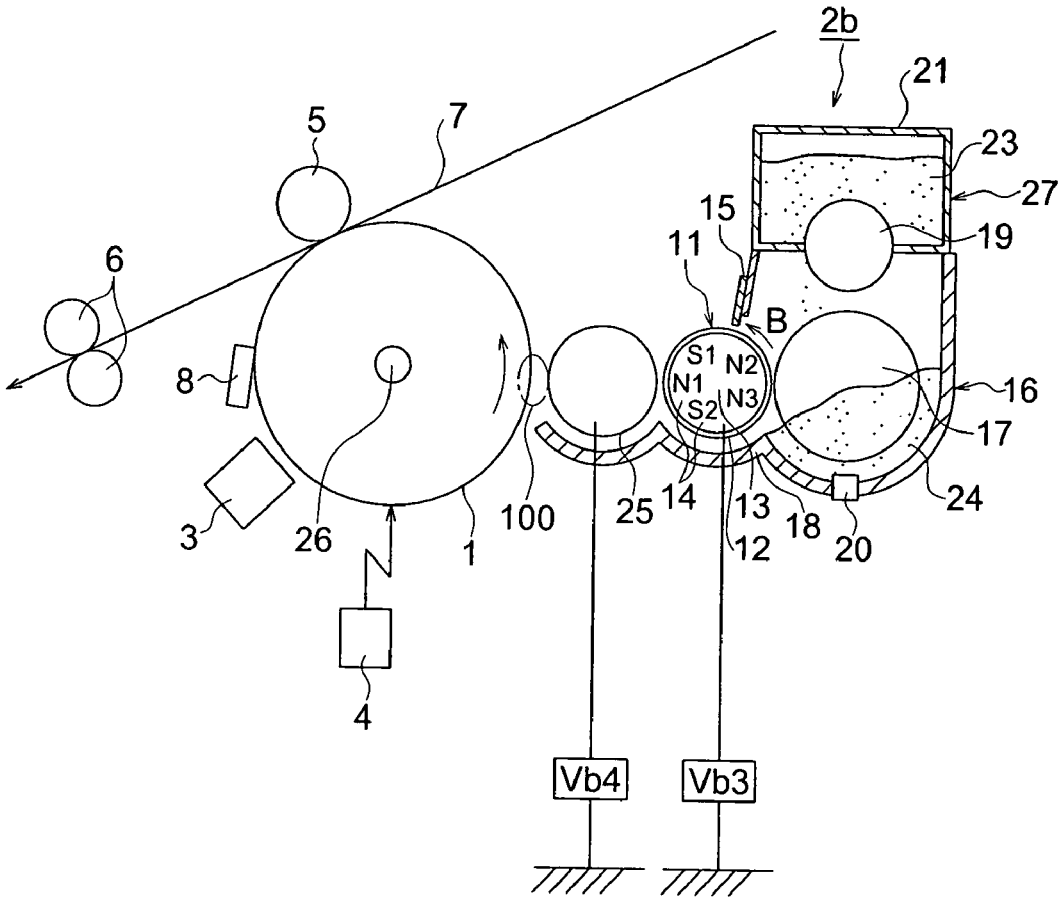
FIG. 3 is a schematic diagram representing an image forming apparatus as a second and a fourth embodiments of the present invention.

FIG. 3 shows an example of the image forming apparatus according to the second embodiment of the present invention. The members having the similar functions as those in FIG. 1 are assigned with the same reference numerals, and description will be omitted to avoid duplication.

(Structure of Developing Unit 2*b*)

The developing unit 2*b* of FIG. 3 adopts the toner supporting member 25 for separating and carrying the toner from the developer on the developer supporting member 11, instead of the opposite polarity particle separating member 22 of FIG. 1, as a separation section for separating the toner or opposite polarity particles from the developer on the developer supporting member 11. As shown in FIG. 3, the toner supporting member 25 is provided between the developer supporting member 11 and image carrier 1, and the toner separation bias under the control depending on the image area ratio is applied by the power source Vb4, whereby toner is electrically separated from the developer on the developer supporting member 11 and is carried on the surface of the toner supporting member 25.

The toner separated and carried by the toner supporting member 25 is conveyed by the toner supporting member 25, and the electrostatic latent image on the image carrier 1 is developed in the development area 100. The developer supporting member 11, the toner supporting member 25 and power source Vb4 correspond to the conveyance mechanism of the present invention.

As described above, in the developing unit 2*b*, differently from the embodiment of FIG. 1, the toner supporting member 25 separates toner from the developer on the developer supporting member 11 and carries it, whereby the electrostatic latent image on the image carrier 1 is developed. The opposite polarity particles are separated from toner by toner separation bias. They remain on the side of the developer supporting member 11, and are collected back into the developer tank 16. The opposite polarity particles having been collected are accumulated in the developer tank 16. This compensates for the charge applying property of the carrier having been deteriorated by repeated printing operations. The opposite polarity particles still adhere on the surface of the separated toner on the toner supporting member 25. In the development area 100, the opposite polarity particles remaining on the toner are consumed by the background portion of the image carrier 1. The amount of the opposite polarity particles is controlled by consumption in the background portion. This arrangement controls the amount of the opposite polarity particles remaining on the toner supporting member 25 subsequent to passage through the development area 100. The opposite polarity particles remaining on the toner supporting member 25 subsequent to passage through the development area 100 are shifted to the developer supporting member 11 and are collected in the developer tank 16. As described above, the amount of the opposite polarity particles consumed in the background portion of the image carrier 1 is controlled in response to the image area ratio, whereby the amount of the opposite polarity particles in the developer tank 16 can be controlled. This arrangement contributes to the compensation for the charge applying property of the deteriorated carrier.

(Control of Separation Voltage)

Figure 4:
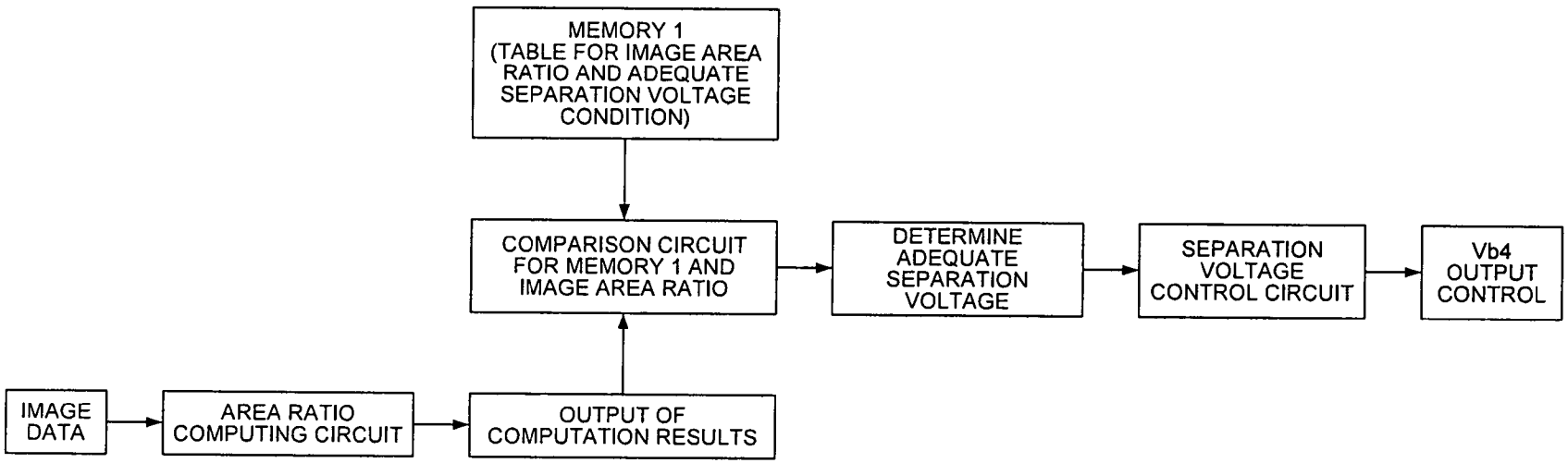
FIG. 4 is a flowchart for controlling the separation voltage depending on the image area ratio as the second embodiment of the present invention.

FIG. 4 is the flowchart for controlling the separation voltage depending on the image area ratio. The method of control is the same as that of the first embodiment. To be more specific, a condition table for the image area ratio and adequate separation voltage is created in advance and the area ratio of the image to be printed is computed by the computing section. Comparison is made, and control is provided in such a way that the adequate separation voltage is outputted from the power source Vb4. The image area ratio is computed based on the image data, but can be computed based on the amount of the toner supplied from the toner supply mechanism, similarly to the case of the first embodiment. It is also possible to make a concurrent use of a mechanism wherein the opposite polarity particle separation ratio is controlled by changing the distance between the toner supporting member 25 and developer supporting member 11. If the distance between the toner supporting member 25 and developer supporting member 11 is changed, the intensity of the electric field working therebetween is changed and the density of the developer is also changed. Thus, the separation ratio can be more preferably controlled. Even at the time of continuously printing an image whose image area ratio is excessively small or large, the image area ratio of the image to be printed is computed and the opposite polarity particle separation ratio is computed based on the result of computation by the control section. Use of this control section provides an adequate amount of the opposite polarity particles in the developer tank 16. Thus, this arrangement provides an image forming apparatus capable of ensuring a long-term compensation for the charge applying property of the carrier that tends to be deteriorated with repeated printing operations.

(Separation and Collection Operation)

The following describes the separation and collection operation of the developing unit 2*b* with reference to FIG. 3:

The toner supporting member 25 is connected with the power source Vb4 and the developer supporting member 11 is connected with the power source Vb3. The toner separation bias controlled depending on the image area ratio is applied by the Vb4, and then the toner is electrically separated from the developer on the developer supporting member 11 and is carried on the surface of the toner supporting member 25. The application of the toner separation bias in this case is conducted within the following range:

The toner separation bias applied to the toner supporting member 25 varies according to the polarity of the charged toner. To be more specific, it is the voltage that takes a higher average value than that of the voltage applied to the developer supporting member 11 when toner is negatively charged. When toner is positively charged, it takes a lower average value than that of the voltage applied to the developer supporting member 11. Regardless of whether the toner is positively or negatively charged, the difference between the average voltage applied to the toner supporting member 25 and that applied to the developer supporting member 11 is preferably 20 through 500 V, more preferably 50 through 300 V. If the difference in potential is too small, the amount of the toner on the toner supporting member 25 will be insufficient to get a satisfactory image density. On the other hand, if the difference in potential is excessive, excessive amount of toner will be supplied and this may lead to unnecessary toner consumption.

In the developing unit 2*b*, it is further preferred that an AC electric field should be formed between the toner supporting member 25 and developer supporting member 11. Formation of an AC electric field causes reciprocal motion of toner, which ensures effective separation between the toner and opposite polarity particles. In this case, an electric field of $2.5\times10^6$ V/m or more is preferably formed. When an electric field of $2.5\times10^6$ V/m or more is formed, opposite polarity particles can be separated from the toner by the electric field as well. This signifies a further improvement in toner separation.

In the present Specification, the electric field formed between the toner supporting member 25 and developer supporting member 11 is referred to as a toner separation field. Such a toner separation field is normally obtained by applying AC voltage to the toner supporting member 25 and/or developer supporting member 11. Especially when AC voltage is applied to the toner supporting member 25 to develop an electrostatic latent image with toner, it is preferred to form a toner separation field using the AC voltage applied to the toner supporting member 25. In this case, the maximum value of the absolute value of the toner separation field should be kept within the aforementioned range.

For example, when toner is positively charged, DC and AC voltages are applied to the developer supporting member 11 and only DC voltage is applied to the toner supporting member 25, then only the DC voltage lower than the average value of the voltage (DC+AC) applied to the developer supporting member 11 is applied to the toner supporting member 25. Further, if toner is negatively charged, DC and AC voltages are applied to the developer supporting member 11 and only DC voltage is applied to the toner supporting member 25, then only the DC voltage higher than the average value of the voltage (DC+AC) applied to the developer supporting member 11 is applied to the toner supporting member 25. In these cases, the maximum value of the absolute value of the toner separation field is the value obtained by dividing the maximum value of the potential difference between the voltage (DC+AC) applied to the developer supporting member 11 and voltage (DC) applied to the toner supporting member 25, by the gap of the nearest portion between the toner supporting member 25 and developer supporting member 11. This value is preferably located within the aforementioned range.

Further, when toner is positively charged, DC and AC voltages are applied to the developer supporting member 11, and AC and DC voltages are applied to the toner supporting member 25, then the DC voltage with the AC electric field superimposed thereto so as to get the average voltage lower than the DC voltage applied to the developer supporting member 11 is applied to the toner supporting member 25. Further, if the toner is negatively charged, only the DC voltage is applied to the developer supporting member 11, and AC and DC voltages are applied to the toner supporting member 25, then the DC voltage with the AC electric field superimposed thereto so as to get the average voltage higher than the DC voltage applied to the developer supporting member 11 is applied to the toner supporting member 25. In these cases, the maximum value of the absolute value of the toner separation field is the value obtained by dividing the maximum value of the potential difference between the voltage (DC) applied to the developer supporting member 11 and voltage (DC+AC) applied to the toner supporting member 25, by the gap of the nearest portion between the toner supporting member 25 and developer supporting member 11. This value is preferably located within the aforementioned range.

Further, when toner is positively charged, and the DC voltage with the AC electric field superimposed thereto is applied to both the developer supporting member 11 and toner supporting member 25, voltage (DC+AC) wherein the average voltage is smaller than that of the voltage (DC+AC) applied to the developer supporting member 11 are applied to the toner supporting member 25. For example, when toner is negatively charged, and the DC voltage with the AC electric field superimposed thereto is applied to both the developer supporting member 11 and toner supporting member 25, voltage (DC+AC) wherein the average voltage is smaller than that of the voltage (DC+AC) applied to the developer supporting member 11 are applied to the toner supporting member 25. In these cases, the maximum value of the absolute value of the toner separation field is the value obtained by dividing the maximum value of the potential difference between the voltage (DC+AC) applied to the developer supporting member 11 and voltage (DC+AC) applied to the toner supporting member 25, resulting from the difference in amplitude, phase, frequency and duty field of the AC voltage component applied to each of them, by the gap of the nearest portion between the toner supporting member 25 and developer supporting member 11. This value is preferably located within the aforementioned range.

The developer remaining on the developer supporting member 11 from which toner is separated by the toner supporting member 25, viz., carrier and opposite polarity particles are directly conveyed by the developer supporting member 11, and are collected into the developer tank 16. In the present embodiment, after separation of toner, opposite polarity particles are directly collected into the developer tank by the developer supporting member 11. This makes it possible to omit the process wherein the opposite polarity particles captured by the opposite polarity particle separating member 22 as described with reference to the embodiment of FIG. 1 are fed back to the developer tank during non-image forming operation.

(Component of Developing Unit 2*b*)

The toner supporting member 25 may be made of any material so long as the aforementioned voltage can be applied. For example, an aluminum roller provided with surface treatment can be used. It is also possible to use the conductive substrate of aluminum or others coated with resins such as polyester resin, polycarbonate resin, acryl resin, polyethylene resin, polypropylene resin, urethane resin, polyamide resin, polyimide resin, polysulfone resin, polyether ketone resin, polyvinyl chloride resin, vinyl acetate resin, silicone resin and fluorine resin; or coated with rubbers such as silicone rubber, urethane rubber, nitrile rubber, natural rubber and isoprene rubber, without the coating material being restricted thereto. Further, a conductive agent may be added to the bulk or surface of the aforementioned coating. The conductive agent is exemplified A by an electron conductive agent or ion conductive agent. The electron conductive agent is exemplified by carbon black such as kechen black, acetylene black and furnace black, or particles such as metallic powder and metallic oxide, without the conductive agent being restricted thereto. The ion conductive agent is exemplified by a cationic compound such as a quaternary ammonium salt, amphoteric compound and other ionic high molecular materials, without being restricted thereto. Further, a conductive roller made of the metallic material such as aluminum can also be employed.

The same materials as those of the first embodiment can be used as other components of the developing unit 2*b*.

(Movement of the Developer)

The following describes the movement of the developer in the developing unit 2*b*:

Similarly to the case of the developing unit 2*a*, the developer 24 inside the developer tank 16 is mixed and stirred by the rotation of the bucket roller 17, and is subjected to triboelectric charging. After that, it is pumped up by the bucket roller 17, and is supplied to the sleeve roller 12 of the developer supporting member 11 surface. This developer 24 is held on the surface side of the sleeve roller 12 by the magnetism of the magnet roller 13 inside the developer supporting member 11, and is moved by rotating with the sleeve roller 12. The amount of passage is regulated by the regulating member 15 arranged face to face with the developer supporting member 11. After that, in the portion opposite the opposite polarity particle separating member 22, only the toner contained in the developer is separated and carried by the toner supporting member 25, as described above. The toner having been separated is conveyed to the development area 100 located facing the image carrier 1. In the development area 100, the toner on the toner supporting member 25 is moved toward the electrostatic latent image on the image carrier 1 by the force given to the toner by the electric field formed between the electrostatic latent image on the image carrier 1 and toner supporting member 25 to which development bias is applied, whereby the electrostatic latent image is developed into a visible image. Either normal development or reversal development method may be used for development. The toner layer on the toner supporting member 25 having passed through the development area 100 is conveyed to the development area 100 after the toner is supplied and corrected by the magnetic brush in the portion opposite the toner supporting member 25 and developer supporting member 11. In the meantime, the developer remaining on the developer supporting member 11 from which the toner has been separated is directly conveyed to the developer tank 16, and is separated from the surface of the developer supporting member 11 by the repulsive magnetic field of the magnetic poles N3 and N2 of the magnetic roller arranged face to face with the bucket roller 17. It is then collected back into the developer tank 16. Upon finding out that the toner density in the developer 24 has been reduced below the lowest toner density for ensuring the image density, the supply control section (not illustrated) arranged on the toner supply mechanism 27 sends the drive start signal to the drive section of the toner supply roller 19, as in the case of FIG. 1. Thus, the supply toner 23 is supplied to the developer tank 16.

In the developing unit 2*b*, not all the opposite polarity particles are collected by the developer supporting member 11. Some of the opposite polarity particles are fed to the toner supporting member 25 together with toner, and are supplied to the development area 100. In the development area, a large proportion of toner and opposite polarity particles are further separated from each other by the operation of the electric field for development. Some of them are not separated from toner and remain sticking on toner. The opposite polarity particles sticking on toner are consumed by the image portion together with the toner. The majority of the opposite polarity particles having been separated are consumed by the non-image portion (background portion). Opposite polarity particles not having consumed by either the image portion or non-image portion are fed back to the developer tank 16 through the developer supporting member 11.

Thus, the amount of the opposite polarity particles to be consumed is also changed by the background portion potential in the development area 100. Further, in the development area 100, the electric field for development is also changed by the change in the gap between the image carrier 1 and toner supporting member 25, and the opposite polarity particle separation ratio is affected thereby. Thus, it is also possible to control the separation ratio in response to the image area ratio through a concurrent use of the background portion potential control section or development gap control section. For example, it is also possible to make such arrangements in the background portion potential control section that the surface potential of the photoreceptor 1 charged by the charging unit 3 is controlled depending on the image area ratio. Moreover, in the development gap control section, a mechanism that controls the distance between the photoreceptor 1 and toner supporting member 25 can be used so that the separation ratio is controlled by the image area ratio.

It is also possible to arrange such a configuration that the developing unit 2*b* is provided with the opposite polarity particle separating member 22 provided on the developing unit 2*a* shown in the embodiment of FIG. 1, thereby further improving the performance of collecting the opposite polarity particles.

The following describes the third and fourth embodiments. The third and fourth embodiments contain a control mechanism for providing control in such a way that the separation ratio of the opposite polarity particles to be separated by the separation section increases with the number of prints.

Third Embodiment

The third embodiment has the same structure as that of the first embodiment of FIG. 1. The only difference from the first embodiment is the method of controlling the separation voltage. Accordingly, the following describes only the differences from the first embodiment, the same functions as those of the first embodiment will be omitted to avoid duplication.

(Structure of Developing Unit 2*a*)

In the developing unit 2*a*, the output voltage of the power source Vb1 is controlled in response to the number of prints created by the developing unit 2*a*, and this controlled voltage provides control in such a way that the opposite polarity particle separation ratio from the developer on the developer supporting member 11 is increased in response to the number of prints.

In the third embodiment, opposite polarity particles are separated prior to development and the opposite polarity particles that are transferred to the image carrier 1 are decreased in number. At the same time, the separation ratio is increased in response to the number of prints. This arrangement optimizes the amount of the opposite polarity particles collected back in the developer tank 16. Thus, the charge applying property of the carrier that is deteriorated with an increase in the number of prints is compensated for by opposite polarity particles, thereby preventing reduction in the amount of electrostatic static charge of the toner. This arrangement provides an image forming apparatus capable of forming an image stabilized for a long period of time.

(Control of Separation Voltage)

Figure 5:
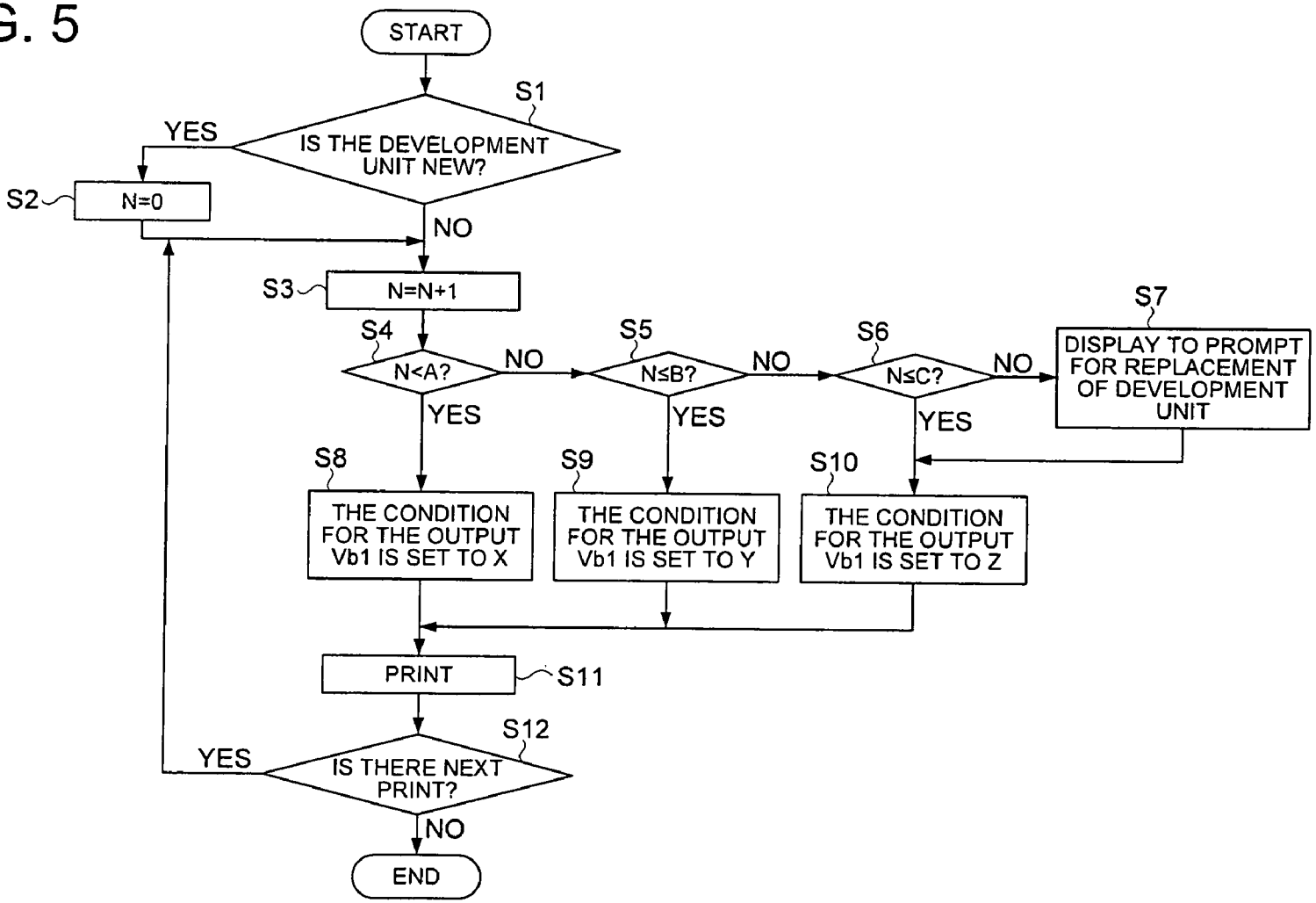
FIG. 5 is a flowchart for controlling the separation voltage depending on the image area ratio as the third embodiment of the present invention.

FIG. 5 is a flowchart showing the control mechanism for controlling the separation voltage in such a way that the opposite polarity particle separation ratio will increase in response to the number of prints. The operation of the control mechanism to be described below can be performed by using the CPU, memory, power source circuit and other devices of the image forming apparatus.

In the first place, upon the start of the printing mode, in the Step S1, a decision step is taken to determine whether the development unit set is new or not. If it is new, the total number of prints N=0 is written in the memory in Step S2. In this case, the memory may be mounted on the developing unit 2*a*, or on the side of the image forming apparatus (main body), together with the individual recognition of the developing unit 2*a*. In Step S3, "1" is added to the total number of prints N. In Step S4, a decision step is taken to determine whether or not N<A. If N<A, the output condition from the power source Vb1 is set to "X" in Step S8, and image forming operation starts in Step S11, whereby a printed output is produced. If the total number of prints N is A or more and less than B, the output condition is set to "Y", and a printed output is produced (S5, S9, S11). Similarly, if the total number of prints N is B or more and less than C, the output condition is set to "Z" (Steps S6 and S10). Further, when the total number of prints N is equal to or greater than C, a prompt for replacement of the development unit is indicated on the display section of the image forming apparatus in Step S7. In this case, the output condition of the Vb1 is arranged in such a way that the opposite polarity particle separation ratio will increase, as the process goes from X to Y and then to Z. In this flowchart, the output condition is changed for a predetermined number of sheets A, B and C. However, it may be changed for every sheet.

As the control mechanism of the separation ratio, it is also possible to make a concurrent use of a mechanism for controlling the gap between the opposite polarity particle separating member 22 and developer supporting member 11, as well as the output condition of the power source as the electric field forming mechanism, as described above.

(Separation and Collection Operation)

The opposite polarity particle separating member 22 is connected to the power source Vb1, and the opposite polarity particle separation bias controlled in response to the number of prints is applied to the opposite polarity particle separating member 22, whereby the opposite polarity particles in the developer are electrically separated and captured on the surface of the opposite polarity particle separating member 22 surface.

The opposite polarity particle separation bias applied to the opposite polarity particle separating member 22 is controlled in response to the number of prints. In this case, it is preferably controlled within the range described with reference to the first embodiment.

(Movement of Developer)

The following describes the movement of the developer in the developing unit 2*a*: The third embodiment is different from the first embodiment in that the opposite polarity particle separation ratio can be controlled in response to the number of prints by making a concurrent use of the background portion potential control section or development gap control section. For example, the background portion potential control section can be configured in such a way that the surface potential of the photoreceptor 1 charged by the charging unit 3 can be controlled in response to the number of prints. Further, the development gap control section can be arranged in such a way so as to use a mechanism that controls the distance between the photoreceptor 1 and developer supporting member 11.

Fourth Embodiment

The fourth embodiment is provided with the image forming apparatus having the same structure as that in the second embodiment of FIG. 3. The only difference from the second embodiment is found in the control of the separation voltage. Thus, to avoid duplication, the same functions as those in the second embodiment will be omitted, and only the difference therefrom will be described.

(Structure of Developing Unit 2*b*)

In the second embodiment, the toner supporting member 25 is designed in such a way that, when the toner separation bias controlled by the image area ratio is applied from the power source Vb4, toner is electrically separated from the developer on the developer supporting member 11 and is carried on the surface of the toner supporting member 25. Thus, when the amount of the opposite polarity particles consumed by the background portion of the image carrier 1 is controlled in response to the image area ratio, the amount of the opposite polarity particles in the developer tank 16 can be controlled, thereby compensating for the charge applying property of the deteriorated carrier. However, in the fourth embodiment, the toner supporting member 25 is configured in such a way that, when the toner separation bias controlled in response to the number of prints is applied from the power source Vb4, toner is electrically separated from the developer on the developer supporting member 1, and is carried on the surface of the toner supporting member 25. Accordingly, when the amount of the opposite polarity particles consumed by the background portion of the image carrier 1 is controlled in response to the number of prints, the amount of the opposite polarity particles in the developer tank 16 can be controlled, thereby compensating for the charge applying property of the deteriorated carrier.

(Control of Separation Voltage)

Figure 6:
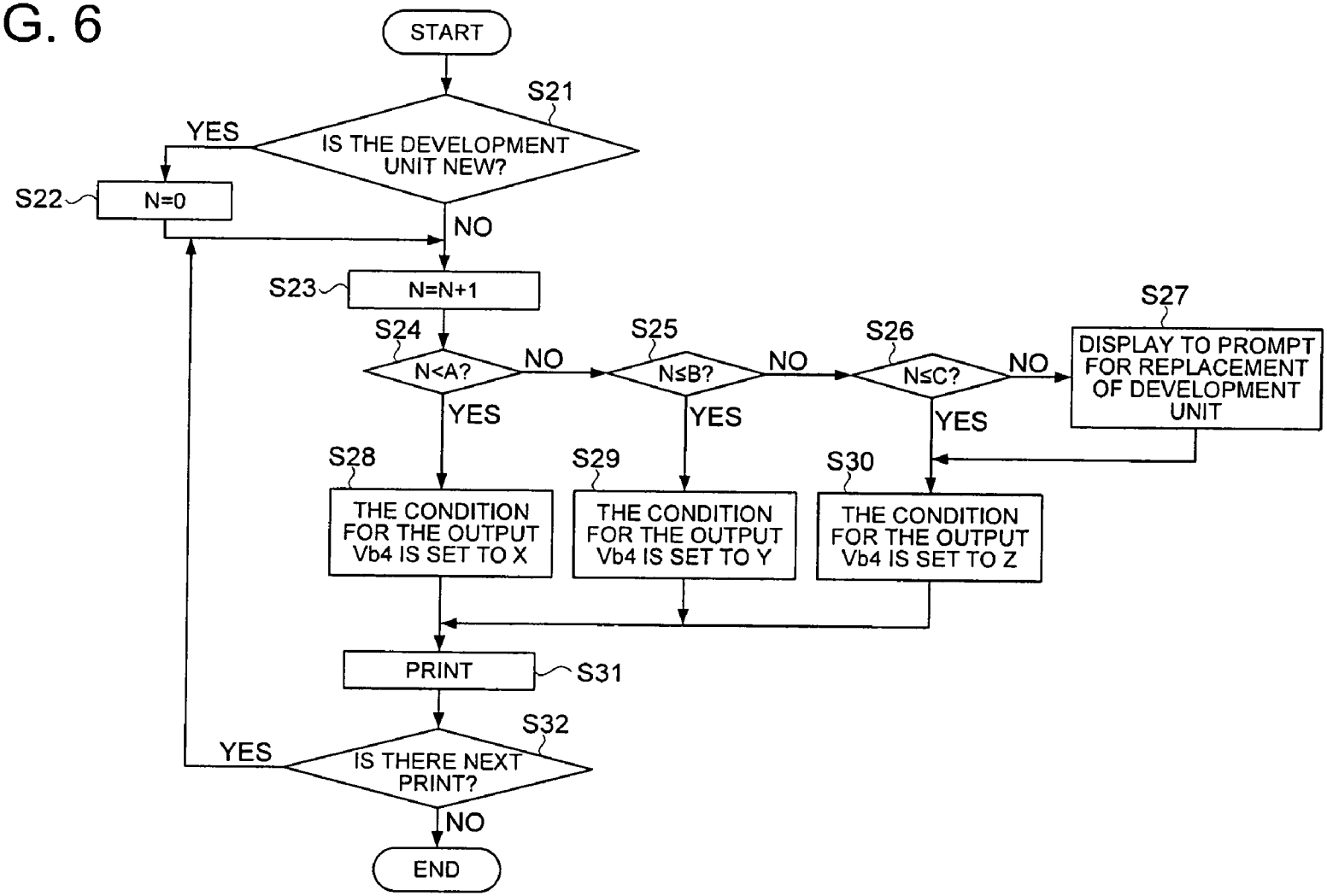
FIG. 6 is a flowchart for controlling the separation voltage depending on the image area ratio as the fourth embodiment of the present invention.

FIG. 6 is a flowchart for controlling the separation voltage in response to the number of prints. In this embodiment, the separation voltage applied to the toner supporting member 25 is controlled so that the voltage in response to the number of prints in the developing unit 2*b* is outputted from the power source Vb4, which corresponds to the electric field forming mechanism of the present invention. Details will be described below.

In FIG. 6, upon the start of the printing mode, in the Step S21, a decision step is taken to determine whether the development unit set is new or not. If it is new, the total number of prints N=0 is written in the memory in Step S22. In this case, the memory may be mounted on the developing unit 2*b*, or on the side of the image forming apparatus (main body), together with the individual recognition of the developing unit 2*b*. In Step S23, "1" is added to the total number of prints N. In Step S24, a decision step is taken to determine whether or not N<A. If N<A, the output condition from the power source Vb4 is set to "X" in Step S28, and image forming operation starts in Step S31, whereby a printed output is produced. If the total number of prints N is A or more and less than B, the output condition is set to "Y", and a printed output is produced (S25, S29, S31). Similarly, if the total number of prints N is B or more and less than C, the output condition is set to "Z" (Steps S26 and S30). Further, when the total number of prints N is equal to or greater than C, a prompt for replacement of the development unit is indicated on the display section of the image forming apparatus in Step S27. In this case, the output condition from the Vb4 is arranged in such a way that the opposite polarity particle separation ratio will increase, as the process goes from X to Y and then to Z. In this flowchart, the output condition is changed for a predetermined number of sheets A, B and C. However, it may be changed for every sheet.

(Separation and Collection)

Referring to FIG. 3, the following describes the operation of separation and collection in the developing unit 2*b:*

The toner supporting member 25 is connected to the power source Vb4, and the developer supporting member 11 is connected to the power source Vb3. The toner separation bias controlled in response to the number of prints in the developing unit 2*b* is applied to the Vb4, whereby toner is electrically separated from the developer on the developer supporting member 11 and is carried on the surface of the toner supporting member 25. In this case, the toner separation bias is applied in the range described with reference to the second embodiment.

(Movement of the Developer)

The following describes the movement of the developer in the developing unit 2*b:*

In the fourth embodiment, the amount of the opposite polarity particles to be consumed varies with the background portion potential of the development area 100 as well. Further, in the development area 100, the development field varies also with a change in the gap between the image carrier 1 and toner supporting member 25, and opposite polarity particle separation ratio is affected accordingly. Thus, control can be made by a concurrent use of the background portion potential control section or development gap control section so that separation ratio increases with the number of prints. For example, the background portion potential control section can be designed in such a way that the surface potential of the photoreceptor 1 charged by the charging unit 3 is controlled in response to the number of prints. Further, as the development gap control section the separation ratio may be controlled in response to the number of prints by using the mechanism that controls the distance between the photoreceptor 1 and toner supporting member 25.

Further, when the developing unit 2*b* is provided with the opposite polarity particle separating member 22 arranged on the developing unit 2*a* shown with reference to the embodiment of FIG. 1, further improvement of the performance of collecting opposite polarity particles can be ensured, and the amount of the adequate opposite polarity particles in response to the number of prints can be collected back into the developer tank 16.

(Effect of Opposite Polarity Particles)

Figure 7:
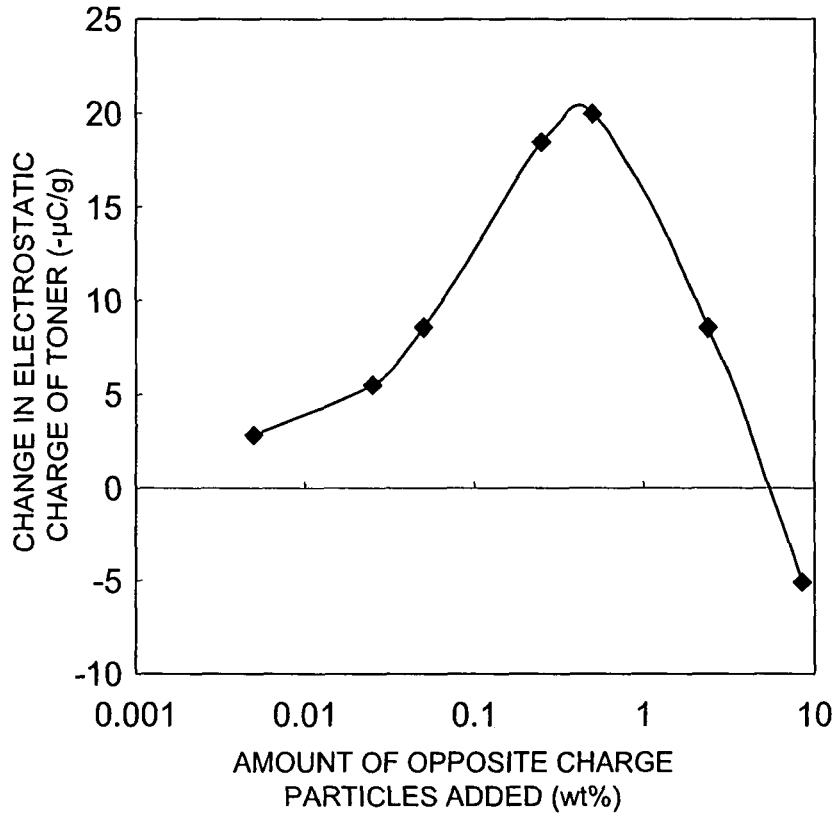
FIG. 7 is a diagram showing an example of the change in the electrostatic charge of toner with respect to the amount of opposite polarity particles added to carrier.

The following describes the effect of assisting the charge applying property of the carrier by the opposite polarity particles, the range of the effective amount to be added, and its influence; FIG. 7 shows an example of the change in the electrostatic charge of toner with respect to the amount of opposite polarity particles added to carrier. Using the carrier for bizhub C350 manufactured by Konica. Minolta Co., Ltd., the carrier was pretreated in advance by changing the amount of the strontium titanate as the opposite polarity particles to be added. The aforementioned toner for the bizhub C350 was mixed with the carrier with different amount of opposite polarity particles to be added thereto so that the mass ratio of the toner would be 8%, whereby a developer was formed. For the carrier with different amount of opposite polarity particles, the electrostatic charge of toner was measured using the devices shown in FIG. 8, thereby obtaining the difference (amount of change) from the electrostatic charge of toner in the developer using the carrier not subjected to treatment with opposite polarity particles. To measure the electrostatic charge of toner, the developer having been weighed was placed uniformly over the surface of the conductive sleeve 31 and, at the same time, the rotational speed of the magnet roll 32 arranged inside this conductive sleeve 31 was set at 1000 rpm. A bias voltage of 2 kV was applied to the polarity same as that of the electrostatic potential of the toner from the bias power source 33 and the aforementioned conductive sleeve 31 was rotated for 15 seconds. The potential Vm in the cylindrical electrode 34 was read when the conductive sleeve 31 was stopped. At the same time, the mass of the toner attached to the cylindrical electrode 34 was weighed by a precision balance, thereby obtaining the amount of electrostatic static charge of the toner. It can be seen in FIG. 7 that electrostatic charge of toner was increased by adding the opposite polarity particles to the carrier. The effect of assisting the electrostatic charge of the carrier by the 4 opposite polarity particles was obtained by a very small amount of addition, and the effect was increased as a result of an increase in the amount to be added. A further increase in the amount to be added reduced the effect of the opposite polarity particles, and the effect was be lost when the amount to be added exceeded about 5% by mass. The reduction in the effect resulting from an increased amount of addition is considered to have been caused by a cancellation of electrostatic charge by the excessive opposite polarity particles moved together with toner, the opposite polarity particles which have difficulty in attaching to the carrier because of too many opposite polarity particles. From the above discussion, it can be seen that, when the strontium titanate is used as opposite polarity particles, the amount of the opposite polarity particles attached on the carrier surface is preferably about 0.01% by mass through 2% by mass, in order to get the effect of assisting the carrier electrostatic charge. Further, even within the preferred range, the scale of the effect to assisting the carrier electrostatic charge by the opposite polarity particles changes with respect to the amount of the opposite polarity particles. Thus, it can be seen that the range of fluctuation of the amount of the opposite polarity particles should be minimized to ensure the stable electrostatic charge of toner. In this case, the amount of the opposite polarity particles to be added is given in terms of the percentage with respect to carrier.

(Description of Behavior of Opposite Polarity Particles)

The following describes the opposite polarity particle separation behavior in the opposite polarity particle collection section and development area.

The opposite polarity particles and toner contained in the developer have different polarities of the electrostatic charge, and hence the directions wherein static electricity works due to electric field are different with each other. This makes it difficult to separate all the toner and opposite polarity particles although partial separation is possible.

In the opposite polarity particle separation section of the developing unit 2*a*, partial separation of the toner and opposite polarity particles is achieved by the electric field formed between the opposite polarity particle separating member 22 and developer supporting member 11, and only the opposite polarity particles are separated from the two-component developer on the developer supporting member 11. Then in the development area, part of the opposite polarity particles which have not been separated by the opposite polarity particle separating member 22 is further separated from toner by the operation of the development field, and is consumed in the background portion. Further, the opposite polarity particles not having been separated from toner even by the development field stick to the image portion together with toner, and are consumed.

Similarly, in the opposite polarity particle separation section of the developing unit 2*b*, partial separation of the toner and opposite polarity particles is achieved by the electric field formed between the toner supporting member 25 and developer supporting member 11. Although some of the opposite polarity particles are collected into the developer tank 16 by the developer supporting member 11, the remaining ones are supplied to the toner supporting member 25 together with the toner, and a further separation between the toner and opposite polarity particles is achieved by the development field of the development area. They are then consumed in the background portion. The opposite polarity particles not having been separated by the development field stick to the image portion together with toner, and are consumed.

In the structures of both the developing unit 2*a* of the first embodiment and developing unit 2*b* the second embodiment, some of the opposite polarity particles are consumed in the image portion or background portion. Accordingly, the amount of the opposite polarity particles to be consumed is changed by the image area ratio. As a result, the amount of the opposite polarity particles contained in the developer of the developer tank 16 is affected by the image area ratio. Thus, the smaller the image area ratio, the smaller the amount of the opposite polarity particles in the developer. The greater the image area ratio, the greater the amount of the opposite polarity particles in the developer.

From the aforementioned discussion, it can be seen that, in the first and the second embodiments, when the image area ratio is smaller, the separation and collection of the opposite polarity particles are encouraged in the opposite polarity particle separation section, while in the development area 100, the separation in the image portion is encouraged, and the separation in the background portion is controlled, whereby the consumption of the opposite polarity particles is reduced. Conversely, when the image area ratio is greater, the separation and collection of the opposite polarity particles are discouraged in the opposite polarity particle separation section, while in the development area the separation of the opposite polarity particles in the image portion is discouraged, and the separation in the background portion is encouraged, whereby the opposite polarity particles are consumed and the amount of the opposite polarity particles in the developer can be stabilized.

(Separation Ratio Control Factor)

The following shows the factors capable of reducing the opposite polarity particle separation ratio in the opposite polarity particle separation section and development area 100: The opposite polarity particles is separated by separating the opposite polarity particles or toner from the two-component developer layer containing the opposite polarity particles, toner and carrier, or by separating the opposite polarity particles or toner from the toner layer containing the opposite polarity particles. Thus, separation of the opposite polarity particles from the two-component developer layer and the separation of the opposite polarity particles from the toner layer were evaluated. In this evaluation, the device shown in FIG. 9 was utilized. The evaluation device of FIG. 9 employed the constitution of the developing unit of FIG. 3.

Figure 9:
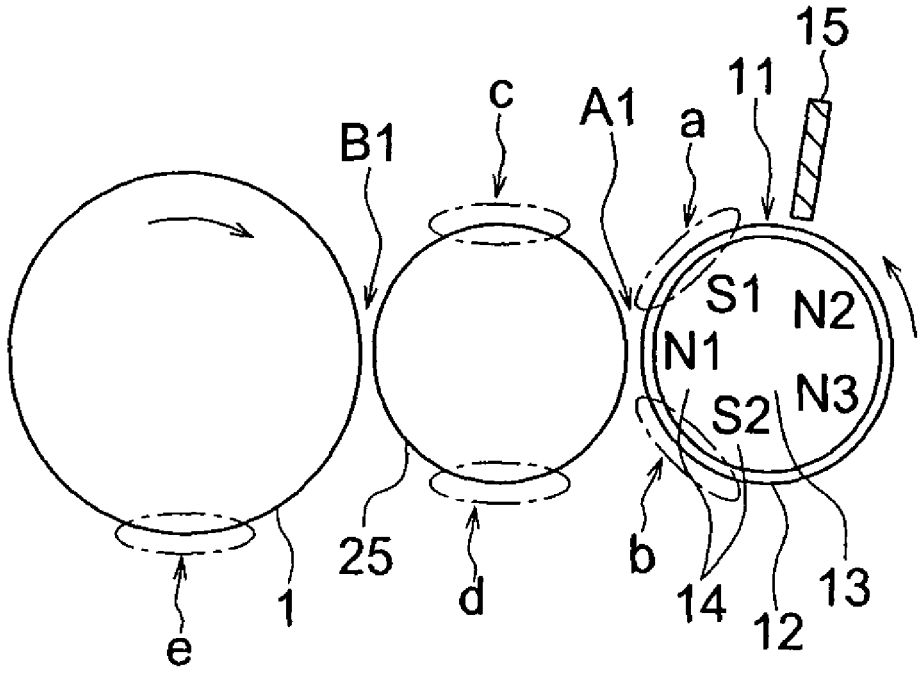
FIG. 9 is a schematic diagram representing part of the developing unit used for evaluation.

In FIG. 9, the opposite polarity particle separation ratio in the two-component developer layer was evaluated at the gap A1 formed by the developer supporting member 11 and toner supporting member 25, and the opposite polarity particle separation ratio in the toner layer was evaluated at the gap B1 made by the toner supporting member 25 and image carrier 1. The separation ratio was obtained by measuring the amounts of the opposite polarity particles contained in the developer or toner in each of the areas a, b, c, d and e in FIG. 9, wherein the measured amounts were assumed as Ga, Gb, Gc, Gd and Ge, respectively. The amount of opposite polarity particles was measured by ICP analysis.

The opposite polarity particle separation ratio is expressed by (Ga−Gb)/Ga when applying the electric field in the direction of separating the opposite polarity particles from the two-component developer layer, namely, when applying electric field in the direction of moving the opposite polarity particles from the developer supporting member 11 to the toner supporting member 25. This separation ratio corresponds to the separation ratio by the opposite polarity particle separating member 22 in the developing unit 2*a* and the separation ratio by the background portion in the development area. This separation ratio and the separation ratio by the background portion in the development area using the developing unit 2*a* are different in the absolute value but exhibit the same tendency.

The opposite polarity particle separation ratio is expressed by (Ga−Gc)/Ga when applying the electric field in the direction of separating the toner from the two-component developer layer, namely, when applying the electric field in the direction of moving the toner from the developer supporting member 11 to the toner supporting member 25. The separation ratio corresponds to the separation ratio by the image portion in the development area using the developing unit 2*a*, and the separation ratio at the opposing positions of the toner supporting member 25 and developer supporting member 11 using the developing unit 2*b*. This separation ratio and the separation ratio by the image portion in the development area using the developing unit 2*a* are different in the absolute value but exhibit the same tendency.

The opposite polarity particle separation ratio is expressed by (Gc−Gd)/Gc when applying the electric field in the direction of moving the opposite polarity particles from the toner layer, namely, when applying the electric field in the field of moving the opposite polarity particles from the toner supporting member 25 to the image carrier 1. This separation ratio corresponds to the separation ratio by the background portion in the development area using the developing unit 2*b*. The opposite polarity particle separation ratio is expressed by (Gc−Ge)/Gc when applying the electric field in the direction of separating toner from the toner layer, namely, when applying the electric field in the direction of moving the toner from the toner supporting member 25 to the image carrier. This separation ratio corresponds to the separation ratio by the image portion in the development area using the developing unit 2*b*.

The carrier for bizhub C350 manufactured by Konica Minolta Co., Ltd., and the negatively charged toner for bizhub C350, treated by external addition of strontium titanate were used in this evaluation, and were prepared so that toner ratio in the developer was 8%.

The factors that change the separation ratio from the two-component developer layer were evaluated under the following conditions: The gap A1 was set at 0.35 mm and the toner supporting member 25 was grounded. Then the voltage was applied to the developer supporting member 11, wherein this voltage was obtained by superimposing the voltage of +200 V DC bias onto the AC bias of rectangular wave having a frequency 4 kHz, a duty ratio of 50% and an amplitude of 1.5 kV when opposite polarity particles were separated from the developer layer, and the voltage superimposed with −200 V DC bias when toner was separated. Under these reference conditions, the separation ratios at the time of changing the factors were measured, whereby these factors were evaluated. Tables 1 through 5 show the separation ratios when each of the AC bias amplitude, duty ratio, frequency, DC bias and gap A1 is changed. In all cases, separation ratios are shown in two directions of electric field for DC bias, viz., in the direction of separating the opposite polarity particles (reference: 200 V), and in the direction of separating toner (reference: −200 V).

TABLE 1

| | Direction of average electric field | |
|---|---|---|
| AC amplitude (kV) | Direction of separating opposite polarity particles Separation ratio | Direction of separating toner Separation ratio |
| 1 | 0.18 | 0.09 |
| 1.5 | 0.24 | 0.15 |
| 2 | 0.3 | 0.22 |

TABLE 2

| Duty ratio (%) | Direction of average electric field: Direction of separating opposite polarity particles Separation ratio | Direction of separating toner Separation ratio |
|---|---|---|
| 45 | 0.29 | 0.11 |
| 50 | 0.24 | 0.15 |
| 55 | 0.2 | 0.2 |

TABLE 3

| AC frequency (kHz) | Direction of average electric field: Direction of separating opposite polarity particles Separation ratio | Direction of separating toner Separation ratio |
|---|---|---|
| 2 | 0.33 | 0.26 |
| 4 | 0.24 | 0.15 |
| 6 | 0.14 | 0.11 |

TABLE 4

| DC bias (V, absolute value) | Direction of average electric field: Direction of separating opposite polarity particles Separation ratio | Direction of separating toner Separation ratio |
|---|---|---|
| 150 | 0.22 | 0.12 |
| 200 | 0.24 | 0.15 |
| 250 | 0.26 | 0.18 |

TABLE 5

| Gap A (mm) | Direction of average electric field: Direction of separating opposite polarity particles Separation ratio | Direction of separating toner Separation ratio |
|---|---|---|
| 0.3 | 0.2 | 0.12 |
| 0.35 | 0.24 | 0.15 |
| 0.4 | 0.27 | 0.17 |

The similar procedure was used to evaluate the factors that change the separation ratio from the toner layer under the following conditions: The gap A1 was set at 0.15 mm and the image carrier 1 was grounded. Then the voltage was applied to the toner supporting member 25, wherein this voltage was obtained by superimposing the voltage of +200 V DC bias onto the AC bias of rectangular wave having a frequency 4 kHz, a duty ratio of 50% and an amplitude of 1.4 kV when opposite polarity particles were separated from the toner layer, and the voltage superimposed with −200 V DC bias when toner was separated. Under these reference conditions, the separation ratios at the time of changing the factors were measured.

A toner layer was formed on the toner supporting member 25 under the same reference conditions as those for the separation of toner from the aforementioned two-component developer layer (viz., supply of toner to the toner supporting member 25). The bias applied to the developer supporting member 11 was superimposed on the bias applied to the toner supporting member 25, whereby the voltage obtained by superimposing a −200 V DC bias on the AC bias of rectangular wave having a frequency of 4 kHz, a duty ratio of 50%, an amplitude of 1.5 kV was applied to the toner supporting member 25. Tables 6 through 10 show the separation ratios when each of the AC bias amplitude, duty ratio, frequency, DC bias and gap B1 is changed. In all cases, separation ratios are shown in two directions of electric field for DC bias, viz., in the direction of separating the opposite polarity particles (reference: 200 V), and in the direction of separating toner (reference: −200 V).

TABLE 6

| AC amplitude (kV) | Direction of average electric field: Direction of separating opposite polarity particles Separation ratio | Direction of separating toner Separation ratio |
|---|---|---|
| 1.2 | 0.3 | 0.23 |
| 1.4 | 0.35 | 0.3 |
| 1.6 | 0.4 | 0.36 |

TABLE 7

| Duty ratio (%) | Direction of average electric field: Direction of separating opposite polarity particles Separation ratio | Direction of separating toner Separation ratio |
|---|---|---|
| 45 | 0.32 | 0.33 |
| 50 | 0.35 | 0.3 |
| 55 | 0.37 | 0.26 |

TABLE 8

| AC frequency (kHz) | Direction of average electric field: Direction of separating opposite polarity particles Separation ratio | Direction of separating toner Separation ratio |
|---|---|---|
| 2 | 0.41 | 0.35 |
| 4 | 0.35 | 0.3 |
| 6 | 0.27 | 0.26 |

TABLE 9

| DC bias (V, absolute value) | Direction of average electric field: Direction of separating opposite polarity particles Separation ratio | Direction of separating toner Separation ratio |
|---|---|---|
| 150 | 0.31 | 0.27 |
| 200 | 0.35 | 0.3 |
| 250 | 0.37 | 0.35 |

TABLE 10

| Gap A (mm) | Direction of average electric field: Direction of separating opposite polarity particles Separation ratio | Direction of separating toner Separation ratio |
|---|---|---|
| 0.12 | 0.4 | 0.35 |
| 0.15 | 0.35 | 0.3 |
| 0.18 | 0.29 | 0.22 |

From the above description, it can be seen that the separation ratios of the toner and opposite polarity particles can be changed by changing the factors in the opposite polarity particle separation section and the image portion and background portion of the development area. When the separation ratio is changed in response to the, number of prints, these factors are changed in the direction of accumulating opposite polarity particles in the developer in response to the sum of the numbers of prints in the developing unit to be used, whereby it is possible to make up for the charge applying property of the carrier that is deteriorated by repeated printing operations, and to ensure the stable electrostatic static charge of the toner.

When the factors that can change the opposite polarity particle separation ratio are to be changed, it is necessary to maintain the range that does not affect formation of an image. These factors can be changed independently or in combination. If they are changed in combination, the range of variation of the separation ratio can be expanded. Further, the amount of opposite polarity particles contained in the developer of the developer tank can be stabilized by combining the changes of the separation ratio in the opposite polarity particle separation section, image portion and background portion. Thus, when the separation ratio is changed in response to the number of prints, it is possible to maintain stable electrostatic charge of toner for a long time. When the separation ratio is changed in response to the image area ratio, even when the image having a unusual image area ratio is continuously printed, it is possible to stabilize the amount of the opposite polarity particles contained in the developer in the developer tank, and to maintain stable electrostatic charge of toner for a long time.

There is no restriction to the time interval for changing the opposite polarity particle separation ratio. It should be set in conformity to the deterioration speed of the carrier caused by conditions for usage. For example, when the separation ratio is to be changed in response to the image area ratio, the ratio can be changed at an interval of 10 through 1000 prints. The shorter this interval, the greater the stability in the amount of the opposite polarity particles of the developer. Even if the ratio is changed at a time interval extremely short with respect to the speed of change in the amount of the opposite polarity particles, the degree of improvement of stability is small. Conversely, if the interval is too long, the amplitude of fluctuation in the amount of the opposite polarity particles will be increased, and stability will be lost. It is necessary to change only the aforementioned factors in response to the average image area ratio for a predetermined number of sheets. Further, in the case of the model wherein image adjustment is to be made at a predetermined number of sheets at the time of turning on the power source or at the time of return from the standby mode, opposite polarity particle separation ratio can be changed at the same timing. This procedure ensures stable printing quality even when the factors affecting the development characteristics are to be changed. When the separation ratio is to be changed in response to the number of prints, the ratio can be changed at an interval of printing a predetermined number of sheets such as 100 sheets or 10000 sheets, or can be changed continuously for every sheet in response to the number of prints. The interval can be reduced as the number of prints is increased, for example, from 50000 to 80000 sheets to 100000.

The image area ratio can be computed based on the exposure signal of the image data, or the amount of supplied toner. When it is computed based on the amount of supplied toner, it can be computed from the time of rotation of the toner supply motor.

The embodiment of the present invention contains a control mechanism that provides control in such a way that the opposite polarity particle separation ratio separated by the separation section increases with the number of prints, and a control mechanism that controls the separation ratio in response to the area ratio of the image portion with respect to the entire image. Even if spent matters of toner and finishing agent to the carrier have been produced with an increase in the number of prints, the opposite polarity particles adequately apply electrostatic charge to the toner. This arrangement provides an image forming apparatus capable of forming a high-quality image by compensating for the reduction in the amount of electrostatic static charge of toner resulting from deterioration of the carrier, and ensuring long-term maintenance of a stable amount of electrostatic static charge of toner.

In the embodiment of the present invention described above, the amount of the opposite polarity particles to be collected back into the developer tank is controlled by controlling the opposite polarity particle separation ratio. In the control in response to the image area ratio, the amount of the opposite polarity particles collected back into the developer tank is kept at a constant level. In the meantime, in the control in response to the total of the number of prints, the amount of the opposite polarity particles collected back into the developer tank is increased. This arrangement ensures formation of a high-quality image for a long time.

EXAMPLE

In the first Example, durability tests were conducted under the various conditions given below, in order to verify the effect of stabilizing the electrostatic charge of toner by changing the opposite polarity particle separation ratio when continuous printing is performed at an extreme image area ratio.

The carrier and toner for the bizhub C350 by Konica Minolta Co., Ltd. were used as the developer. The aforementioned toner is a negative charging toner wherein opposite polarity particles are treated by external addition of strontium titanate. The proportion of toner in the developer was 8% by mass.

The photocopier bizhub C350 manufactured by Konica Minolta Co., Ltd. was modified and the image area ratio was switched among 10% for the first 10000 sheets, 50% from 10000 through 30000 sheets, and 2% for 30000 through 50000 to conduct a durability test on 50000 sheets.

<Condition 1>

A development bias of rectangular wave having an amplitude of 1.5 kV, a duty ratio of 50%, a frequency of 4 kHz, and a DC component of −400 V was applied to the developer supporting member 11 using the developing unit of FIG. 1, and a −550 V DC bias was applied to the opposite polarity particle separating member 22. An aluminum roller provided with alumite processing on the surface was used as the opposite polarity particle separating member 22. The gap between the developer supporting member 11 and opposite polarity particle separating member 22 at the nearest portion was 0.3 mm. The background portion potential of the electrostatic latent image on the photoreceptor was −550 V, and the image portion potential was −60 V. The gap between the photoreceptor 1 and developer supporting member 11 at the nearest portion was 0.35 mm.

<Condition 2>

A development bias of rectangular wave having an amplitude of 1.2 kV, a duty ratio of 50%, a frequency of 4 kHz, and a DC component of −400 V was applied to the developer supporting member 11 using the developing unit of FIG. 1, and a −500 V DC bias was applied to the opposite polarity particle separating member 22. An aluminum roller provided with alumite processing on the surface was used as the opposite polarity particle separating member 22. The gap between the developer supporting member 11 and opposite polarity particle separating member 22 at the nearest portion was 0.3 mm. The background portion potential of the electrostatic latent image on the photoreceptor was −600 V, and the image portion potential was −60 V. The gap between the photoreceptor 1 and developer supporting member 11 at the nearest portion was 0.35 mm.

<Condition 3>

A development bias of rectangular wave having an amplitude of 1.8 kV, a duty ratio of 50%, a frequency of 4 kHz, and a DC component of −400 V was applied to the developer supporting member 11 using the developing unit of FIG. 1, and a −600 V DC bias was applied to the opposite polarity particle separating member 22. An aluminum roller provided with alumite processing on the surface was used as the opposite polarity particle separating member 22. The gap between the developer supporting member 11 and opposite polarity particle separating member 22 at the nearest portion was 0.3 mm. The background portion potential of the electrostatic latent image on the photoreceptor 1 was −500 V, and the image portion potential was −60 V. The gap between the photoreceptor 1 and developer supporting member 11 at the nearest portion was 0.35 mm.

<Condition 4>

A development bias of rectangular wave having an amplitude of 1.5 kV, a duty ratio of 50%, a frequency of 4 kHz, and a DC component of −400 V was applied to the developer supporting member 11 using the developing unit of FIG. 1, and a rectangular wave bias having an amplitude 500 V, a duty ratio of 50%, a frequency of 4 kHz and a DC component of −500 V was applied to the opposite polarity particle separating member 22. In this case, the phases of the bias applied to the developer supporting member 11 and opposite polarity particle separating member 22 were the same so that the vibrating electric field between the developer supporting member 11 and opposite polarity particle separating member 22 was reduced (cancelled). An aluminum roller provided with alumite processing on the surface was used as the opposite polarity particle separating member 22. The gap between the developer supporting member 11 and opposite polarity particle separating member 22 at the nearest portion was 0.35 mm. The background portion potential of the electrostatic latent image on the photoreceptor 1 was −550 V, and the image portion potential was −60 V. The gap between the photoreceptor 1 and developer supporting member 11 at the nearest portion was 0.35 mm.

<Condition 5>

A development bias of rectangular wave having an amplitude of 1.5 kV, a duty ratio of 50%, a frequency of 4kHz, and a DC component of −400 V was applied to the developer supporting member 11 using the developing unit of FIG. 1, and a rectangular wave bias having an amplitude 500 V, a duty ratio of 50%, a frequency of 4 kHz and a DC component of −500 V was applied to the opposite polarity particle separating member 22. In this case, the phases of the bias applied to the developer supporting member 11 and opposite polarity particle separating member 22 were shifted so that the vibration field between the developer supporting member 11 and opposite polarity particle separating member 22 was increased. An aluminum roller provided with alumite processing on the surface was used as the opposite polarity particle separating member 22. The gap between the developer supporting member 11 and opposite polarity particle separating member 22 at the nearest portion was 0.25 mm. The background portion potential of the electrostatic latent image on the photoreceptor 1 was −550 V, and the image portion potential was −60 V. The gap between the photoreceptor 1 and developer supporting member 11 at the nearest portion was 0.35 mm.

<Condition 6>

A −400 V DC voltage was applied to the developer supporting member 11 using the developing unit of FIG. 3, and a development bias of rectangular wave having an amplitude of 500 V, a duty ratio of 60%, a frequency of 4 kHz and a DC component of −340 V was applied to the toner supporting member 25. An aluminum roller provided with alumite processing on the surface was used as the toner supporting member 25. The gap between the developer supporting member 11 and toner supporting member 25 at the nearest portion was 0.3 mm. The background portion potential of the electrostatic latent image on the photoreceptor 1 was −550 V, and the image portion potential was −60 V. The gap between the photoreceptor 1 and toner supporting member 25 at the nearest portion was 0.15 mm.

<Condition 7>

A −400 V DC voltage was applied to the developer supporting member 11 using the developing unit of FIG. 3, and a development bias of rectangular wave having an amplitude of 1.4 kV, a duty ratio of 60%, a frequency of 4 kHz and a DC component −410 V was applied to the toner supporting member 25. An aluminum roller provided with alumite processing on the surface was used as the toner supporting member 25. The gap between the developer supporting member 11 and toner supporting member 25 at the nearest portion was 0.3 mm. The background portion potential of the electrostatic latent image on the photoreceptor 1 was −600 V, and the image portion potential was −60 V. The gap between the photoreceptor 1 and toner supporting member 25 at the nearest portion was 0.15 mm.

<Condition 8>

A −400 V DC voltage was applied to the developer supporting member 11 using the developing unit of FIG. 3, and a development bias of rectangular wave having an amplitude of 1.4 kV, a duty ratio of 55%, a frequency of 2 kHz and a DC component −270 V was applied to the toner supporting member 25. An aluminum roller provided with alumite processing on the surface was used as the toner supporting member 25. The gap between the developer supporting member 11 and toner supporting member 25 at the nearest portion was 0.3 mm. The background portion potential of the electrostatic latent image on the photoreceptor 1 was −500 V, and the image portion potential was −60 V. The gap between the photoreceptor 1 and toner supporting member 25 at the nearest portion was 0.15 mm.

<Condition 9>

A rectangular wave bias having an amplitude 500 V, a duty ratio of 65%, a frequency of 4 kHz and a DC component of −475 V was applied to the developer supporting member 11 using the developing unit of FIG. 3, and a development bias of rectangular wave having an amplitude of 1.4 kV, a duty ratio of 65%, a frequency of 4 kHz and a DC component −410 V was applied to the toner supporting member 25. The rectangular waves applied to the developer supporting member 11 and toner supporting member 25 had the same phase so that the electric field between the developer supporting member 11 and toner supporting member 25 was reduced (cancelled). An aluminum roller provided with alumite processing on the surface was used as the toner supporting member 25. The gap between the developer supporting member 11 and toner supporting member 25 at the nearest portion was 0.3 mm. The background portion potential of the electrostatic latent image on the photoreceptor 1 was −550 V, and the image portion potential was −60 V. The gap between the photoreceptor 1 and toner supporting member 25 at the nearest portion was 0.15 mm.

<Condition 10>

A rectangular wave bias having an amplitude 500 V, a duty ratio of 45%, a frequency of 4 kHz and a DC component of −375 V was applied to the developer supporting member 11 using the developing unit of FIG. 3, and a development bias of rectangular wave having an amplitude of 1.4 kV, a duty ratio of 55%, a frequency of 4 kHz and a DC component −270 V was applied to the toner supporting member 25. The phases of the rectangular waves applied to the developer supporting member 11 and toner supporting member 25 were shifted so that the electric field between the developer supporting member 11 and toner supporting member 25 was increased. An aluminum roller provided with alumite processing on the surface was used as the toner supporting member 25. The gap between the developer supporting member 11 and toner supporting member 25 at the nearest portion was 0.3 mm. The background portion potential of the electrostatic latent image on the photoreceptor 1 was −550 V, and the image portion potential was −60 V. The gap between the photoreceptor 1 and toner supporting member 25 at the nearest portion was 0.15 mm.

It has been made clear in the experiments in advance that the Conditions 1 and 6 represent the setting conditions wherein an adequate separation ratio is obtained at an image area ratio of 10%; Condition 2, 4, 7 and 9 represent the setting conditions wherein an adequate separation ratio is obtained at an image area ratio of 50%; and Condition 3, 5, 8 and 10 represent the setting conditions wherein an adequate separation ratio is obtained at an image area ratio of 2%.

Example 1

A durability test was conducted by switching the conditions so that Condition 1 was for the image area ratio of 10%, Condition 2 was for the image area ratio of 50%, and Condition 3 was for the image area ratio of 2%.

Example 2

A durability test was conducted by switching the conditions so that Condition 1 was for the image area ratio of 10%, Condition 4 was for the image area ratio of 50%, and Condition 5 was for the image area ratio of 2%.

Example 3

A durability test was conducted by switching the conditions so that Condition 6 was for the image area ratio of 10%, Condition 7 was for the image area ratio of 50%, and Condition 8 was for the image area ratio of 2%.

Example 4

A durability test was conducted by switching the conditions so that Condition 6 was for the image area ratio of 10%, Condition 9 was for the image area ratio of 50%, and Condition 10 was for the image area ratio of 2%.

Comparative Example 1

A durability test was conducted under Condition 1 without referring to an image area ratio.

Comparative Example 2

A durability test was conducted under Condition 2 without referring to an image area ratio.

Comparative Example 3

A durability test was conducted under Condition 3 without referring to an image area ratio.

Comparative Example 4

A durability test was conducted under Condition 4 without referring to an image area ratio.

Comparative Example 5

A durability test was conducted under Condition 5 without referring to an image area ratio.

Comparative Example 6

A durability test was conducted under Condition 6 without referring to an image area ratio.

Comparative Example 7

A durability test was conducted under Condition 7 without referring to an image area ratio.

Comparative Example 8

A durability test was conducted under Condition 8 without referring to an image area ratio.

Comparative Example 9

A durability test was conducted under Condition 9 without referring to an image area ratio.

Comparative Example 10

A durability test was conducted under Condition 10 without referring to an image area ratio.

Table 11 shows the result of evaluating the electrostatic charge of toner in the developers sampled for every 5000 prints, using the equipment of FIG. 8.

TABLE 11

| | Electrostatic charge of toner (−μC/g) Number of prints | | | | | | | | | | | Range of variation in |
|---|---|---|---|---|---|---|---|---|---|---|---|---|
| | Initial | 5000 | 10000 | 15000 | 20000 | 25000 | 30000 | 35000 | 40000 | 45000 | 50000 | electorstatic charge of |
| | Image area rate | | | | | | | | | | | |
| | — | 10% | 10% | 50% | 50% | 50% | 50% | 2% | 2% | 2% | 2% | toner (μC/g) |
| Examp. 1 | 32.1 | 31.4 | 32.3 | 33.0 | 34.2 | 33.2 | 34.1 | 32.9 | 31.4 | 32.2 | 32.4 | 2.8 |
| Examp. 2 | 34.0 | 32.5 | 32.1 | 33.1 | 32.8 | 35.0 | 35.9 | 33.6 | 32.9 | 32.8 | 32.0 | 3.9 |
| Examp. 3 | 33.2 | 33.9 | 33.2 | 32.8 | 33.5 | 34.2 | 33.9 | 33.1 | 32.2 | 32.5 | 33.7 | 2.0 |
| Examp. 4 | 34.9 | 32.9 | 33.4 | 34.3 | 34.0 | 34.1 | 33.8 | 33.0 | 31.3 | 32.5 | 31.2 | 3.7 |
| Comp. 1 | 32.2 | 32.9 | 32.6 | 33.9 | 34.1 | 33.7 | 35.6 | 32.0 | 31.8 | 30.6 | 29.8 | 5.8 |
| Comp. 2 | 34.1 | 33.2 | 31.9 | 33.1 | 32.8 | 33.5 | 34.4 | 30.2 | 28.9 | 26.8 | 24.3 | 10.1 |
| Comp. 3 | 31.9 | 32.5 | 32.7 | 34.6 | 36.2 | 38.9 | 39.3 | 35.2 | 34.5 | 33.2 | 32.4 | 7.4 |
| Comp. 4 | 32.1 | 31.9 | 32.2 | 34.5 | 33.2 | 35.0 | 34.3 | 32.1 | 29.8 | 28.6 | 25.6 | 9.4 |
| Comp. 5 | 33.8 | 34.0 | 34.5 | 36.3 | 36.8 | 35.9 | 38.9 | 34.4 | 30.4 | 31.2 | 32.2 | 8.5 |
| Comp. 6 | 32.8 | 31.9 | 33.0 | 34.0 | 34.8 | 34.3 | 35.0 | 31.1 | 29.1 | 29.8 | 28.4 | 6.6 |
| Comp. 7 | 33.0 | 32.2 | 31.3 | 33.5 | 34.3 | 33.9 | 34.4 | 29.8 | 24.5 | 23.6 | 23.8 | 10.8 |
| Comp. 8 | 34.1 | 33.8 | 33.6 | 37.2 | 36.3 | 40.2 | 38.0 | 33.3 | 34.1 | 32.9 | 33.0 | 7.3 |
| Comp. 9 | 33.6 | 33.2 | 31.2 | 32.1 | 32.9 | 33.2 | 32.9 | 30.4 | 26.5 | 26.3 | 24.2 | 9.4 |
| Comp. 10 | 32.9 | 31.6 | 32.9 | 34.8 | 36.5 | 36.8 | 37.9 | 33.0 | 34.3 | 32.4 | 31.9 | 6.3 |

Examp.: Example,

Comp.: Comparative example

Table 11 shows that, in the Examples of the present invention, the variation in electrostatic charge of toner was kept at 4 μC/g or less although continuous printing was conducted at an extreme image area ratio of 2 or 50% in the process from the initial phase to 50000 prints, whereas the variation in electrostatic charge of toner exceeded 5 μc/g in any one of the Comparative Examples. This has verified the effects of the present invention.

As described above, separation voltage is controlled in such a way as to change the opposite polarity particle separation ratio in response to the image area ratio. This ensures a proper balance to be maintained between the consumption of the opposite polarity particles and accumulation in the developer tank 16 over an extensive range of image area ratios, and provides advantages of effectively assisting the electrostatic charge of carrier by the opposite polarity particles, whereby stable electrostatic charge characteristic of the toner can be maintained for a long period of time. Thus, the deterioration of the carrier can be reduced for a long time, and a stable amount of electrostatic static charge of toner can be ensured through high-volume printing, thereby ensuring a long-term service life of the developing unit. Thus, this arrangement provides an image forming apparatus capable of producing high-quality images for a long period of time.

The following describes the Examples wherein the separation ratio of the opposite polarity particles is changed in response to the number of prints:

The carrier and toner for the bizhub C350 by Konica Minolta Co., Ltd. were used for the developer. The aforementioned toner is a negative charging toner treated with external addition of strontium titanate as opposite polarity particles. The toner ratio in the developer was 8%.

The photocopier bizhub C350 by Konica Minolta Co., Ltd. was modified and 200,000 charts were printed at an image area ratio of 5%. The following shows the setting conditions of the equipment:

<Condition 11>

A development bias of rectangular wave having an amplitude of 1.5 kV, a duty ratio of 50%, a frequency of 4 kHz, and a DC component of −400 V was applied to the developer supporting member 11 using the developing unit 2*a* of FIG. 1, and a −550 V DC bias was applied to the opposite polarity particle separating member 22. An aluminum roller provided with alumite processing on the surface was used as the opposite polarity particle separating member 22. The gap between the developer supporting member 11 and opposite polarity particle separating member 22 at the nearest portion was 0.3 mm. The background portion potential of the electrostatic latent image on the photoreceptor was −550 V, and the image portion potential was −60 V. The gap between the photoreceptor 1 and developer supporting member 11 at the nearest portion was 0.35 mm.

<Condition 12>

A development bias of rectangular wave having an amplitude of 1.8 kV, a duty ratio of 50%, a frequency of 4 kHz, and a DC component of −400 V was applied to the developer supporting member 11 using the developing unit 2*a* of FIG. 1, and a −600 V DC bias was applied to the opposite polarity particle separating member 22. An aluminum roller provided with alumite processing on the surface was used as the opposite polarity particle separating member 22. The gap between the developer supporting member 11 and opposite polarity particle separating member 22 at the nearest portion was 0.3 mm. The background portion potential of the electrostatic latent image on the photoreceptor was −500 V, and the image portion potential was −60 V. The gap between the photoreceptor 1 and developer supporting member 11 at the nearest portion was 0.35 mm.

<Condition 13>

A development bias of rectangular wave having an amplitude of 1.5 kV, a duty ratio of 50%, a frequency of 4 kHz, and a DC component of −400 V was applied to the developer supporting member 11 using the developing unit 2*a* of FIG. 1, and the rectangular bias having an amplitude of 250 V, a duty ratio of 50%, a frequency of 4 kHz, and a DC component of −550 V was applied to the opposite polarity particle separating member 22. In this case, the phases of the bias applied to the developer supporting member 11 and opposite polarity particle separating member 22 were shifted so that the vibration field between the developer supporting member 11 and opposite polarity particle separating member 22 was increased. An aluminum roller provided with alumite processing on the surface was used as the opposite polarity particle separating member 22. The gap between the developer supporting member 11 and opposite polarity particle separating member 22 at the nearest portion was 0.25 mm. The background portion potential of the electrostatic latent image on the photoreceptor 1 was −550 V, and the image portion potential was −60 V. The gap between the photoreceptor 1 and developer supporting member 11 at the nearest portion was 0.35 mm.

<Condition 14>

A development bias of rectangular wave having an amplitude of 1.5 kV, a duty ratio of 50%, a frequency of 4 kHz, and a DC component of −400 V was applied to the developer supporting member 11 using the developing unit 2*a* of FIG. 1, and the rectangular bias having an amplitude of 500 V, a duty ratio of 50%, a frequency of 4 kHz, and a DC component of −600 V was applied to the opposite polarity particle separating member 22. In this case, the phases of the bias applied to the developer supporting member 11 and opposite polarity particle separating member 22 were reverse to each other so that the vibration field between the developer supporting member 11 and opposite polarity particle separating member 22 was increased. An aluminum roller provided with alumite processing on the surface was used as the opposite polarity particle separating member 22. The gap between the developer supporting member 11 and opposite polarity particle separating member 22 at the nearest portion was 0.25 mm. The background portion potential of the electrostatic latent image on the photoreceptor 1 was −550 V, and the image portion potential was −60 V. The gap between the photoreceptor 1 and developer supporting member 11 at the nearest portion was 0.35 mm.

<Condition 15>

A −400 V DC voltage was applied to the developer supporting member 11 using the developing unit 2*b* of FIG. 3, and the development bias of rectangular wave having an amplitude of 1.4 kV, a duty ratio of 60%, a frequency of 4 kHz, and a DC component of −340 V was applied to the toner supporting member 25. An aluminum roller provided with alumite processing on the surface was used as the toner supporting member. The gap between the developer supporting member 11 and toner supporting member 25 at the nearest portion was 0.3 mm. The background portion potential of the electrostatic latent image on the photoreceptor 1 was −550 V, and the image portion potential was −60 V. The gap between the photoreceptor 1 and the toner supporting member 25 at the nearest portion was 0.15 mm.

<Condition 16>

A −400 V DC voltage was applied to the developer supporting member 11 using the developing unit 2*b* of FIG. 3, and the development bias of rectangular wave having an amplitude of 1.4 kV, a duty ratio of 55%, a frequency of 2 kHz, and a DC component of −270 V was applied to the toner supporting member 25. An aluminum roller provided with alumite processing on the surface was used as the toner supporting member 25. The gap between the developer supporting member 11 and toner supporting member 25 at the nearest portion was 0.3 mm. The background portion potential of the electrostatic latent image on the photoreceptor 1 was −500 V, and the image portion potential was −60 V. The gap between the photoreceptor 1 and the toner supporting member 25 at the nearest portion was 0.15 mm.

<Condition 17>

A rectangular bias having an amplitude of 500 kV, a duty ratio of 45%, a frequency of 4 kHz, and a DC component of −375 V was applied to the developer supporting member 11 using the developing unit 2*b* of FIG. 3, and the development bias of rectangular wave having an amplitude of 1.4 kV, a duty ratio of 55%, a frequency of 4 kHz, and a DC component of −270 V was applied to the toner supporting member 25. The phases of the bias applied to the developer supporting member 11 and toner supporting member 25 were shifted so that the electric field between the developer supporting member 11 and toner supporting member 25 was increased. An aluminum roller provided with alumite processing on the surface was used as the toner supporting member 25. The gap between the developer supporting member 11 and toner supporting member 25 at the nearest portion was 0.3 mm. The background portion potential of the electrostatic latent image on the photoreceptor 1 was −550 V, and the image portion potential was −60 V. The gap between the photoreceptor 1 and toner supporting member 25 at the nearest portion was 0.15 mm.

<Condition 18>

A rectangular bias having an amplitude of 800 kV, a duty ratio of 50%, a frequency of 4 kHz, and a DC component of −400 V was applied to the developer supporting member 11 using the developing unit 2*b* of FIG. 3, and the development bias of rectangular wave having an amplitude of 1.4 kV, a duty ratio of 50%, a frequency of 4 kHz, and a DC component of −200 V was applied to the toner supporting member 25. The phases of the bias applied to the developer supporting member 11 and toner supporting member 25 were shifted so that the electric field between the developer supporting member 11 and toner supporting member 25 was increased. An aluminum roller provided with alumite processing on the surface was used as the toner supporting member 25. The gap between the developer supporting member 11 and toner supporting member 25 at the nearest portion was 0.3 mm. The background portion potential of the electrostatic latent image on the photoreceptor 1 was −550 V, and the image portion potential was −60 V. The gap between the photoreceptor 1 and toner supporting member 25 at the nearest portion was 0.15 mm.

Example 5

A durability test was conducted by switching between Condition 11 for up to 100,000 sheets and Condition 12 for 100,000 through 200,000 sheets.

Example 6

A durability test was conducted by switching among Condition 11 for up to 100,000 sheets, Condition 13 for 100,000 through 150,000 sheets, and Condition 14 for 150,000 through 200,000 sheets.

Example 7

A durability test was conducted by switching among Condition 15 for 100,000 through 150,000 sheets, and Condition 16 for 100,000 through 200,000 sheets.

Example 8

A durability test was conducted by switching among Condition 15 for up to 100,000 sheets, Condition 17 for 100,000 through 150,000 sheets, and Condition 18 for 150,000 through 200,000 sheets.

Comparative Example 11

A durability test was conducted under Condition 11 for up to 200,000 sheets.

Comparative Example 12

A durability test was conducted under Condition 12 for up to 200,000 sheets.

Comparative Example 13

A durability test was conducted under Condition 13 for up to 200,000 sheets.

Comparative Example 14

A durability test was conducted under Condition 14 for up to 200,000 sheets.

Comparative Example 15

A durability test was conducted under Condition 15 for up to 200,000 sheets.

Comparative Example 16

A durability test was conducted under Condition 16 for up to 200,000 sheets.

Comparative Example 17

A durability test was conducted under Condition 17 for up to 200,000 sheets.

Comparative Example 18

A durability test was conducted under Condition 18 for up to 200,000 sheets.

Comparative Example 19

A durability test was conducted by switching between Condition 12 for up to 100,000 sheets, and Condition 11 for 100,000 through 200,000 sheets.

Comparative Example 20

A durability test was conducted by switching among Condition 14 for up to 100,000 sheets, Condition 13 for 100,000 through 150,000 sheets, and Condition 11 for 150,000 through 200,000 sheets.

Table 12 shows the result of evaluating the electrostatic charge of toner in the developers sampled for every 20000 prints, using the equipment of FIG. 3.

TABLE 12

| | Electrostatic charge of toner (−μC/g) Number of prints | | | | | | | | | | | Range of variation in electrostatic charge of |
|---|---|---|---|---|---|---|---|---|---|---|---|---|
| | Initial | 20000 | 40000 | 60000 | 80000 | 100000 | 120000 | 140000 | 160000 | 180000 | 200000 | toner (μC/g) |
| Examp. 5 | 32.5 | 33.2 | 33.1 | 33.0 | 32.5 | 32.0 | 34.8 | 33.5 | 32.0 | 32.3 | 31.4 | 3.4 |
| Examp. 6 | 33.0 | 31.2 | 32.0 | 31.8 | 31.5 | 31.7 | 32.8 | 32.3 | 34.1 | 33.2 | 32.8 | 2.9 |
| Examp. 7 | 32.2 | 33.1 | 31.8 | 32.0 | 31.2 | 31.4 | 34.0 | 32.5 | 32.2 | 32.3 | 32.0 | 2.8 |
| Examp. 8 | 33.1 | 33.0 | 32.8 | 31.8 | 32.2 | 31.6 | 34.5 | 32.4 | 35.0 | 33.0 | 33.2 | 3.4 |
| Comp. 11 | 32.5 | 32.8 | 32.4 | 31.9 | 32.1 | 32.0 | 31.4 | 31.0 | 30.2 | 28.5 | 27.0 | 5.8 |
| Comp. 12 | 31.8 | 40.2 | 39.2 | 38.5 | 37.2 | 38.1 | 36.9 | 35.2 | 36.6 | 34.5 | 34.0 | 8.4 |
| Comp. 13 | 32.3 | 36.0 | 35.2 | 35.1 | 34.5 | 34.2 | 33.8 | 32.9 | 32.5 | 31.3 | 29.5 | 6.5 |
| Comp. 14 | 32.0 | 38.2 | 37.5 | 37.3 | 36.8 | 37.0 | 35.6 | 36.5 | 35.0 | 34.6 | 33.2 | 6.2 |
| Comp. 15 | 32.6 | 32.2 | 33.1 | 31.9 | 32.6 | 31.9 | 30.6 | 29.8 | 28.1 | 26.6 | 24.0 | 9.1 |
| Comp. 16 | 33.2 | 41.2 | 41.4 | 40.0 | 39.5 | 38.9 | 39.5 | 38.5 | 37.2 | 38.0 | 36.1 | 8.2 |
| Comp. 17 | 32.2 | 37.9 | 35.1 | 36.6 | 35.9 | 33.9 | 34.2 | 35.1 | 33.2 | 31.2 | 31.8 | 6.7 |
| Comp. 18 | 32.9 | 39.5 | 41.2 | 40.0 | 38.5 | 39.5 | 38.2 | 36.6 | 38.2 | 35.9 | 34.4 | 8.3 |
| Comp. 19 | 32.9 | 39.5 | 40.1 | 39.4 | 37.2 | 37.5 | 32.1 | 30.0 | 28.5 | 29.5 | 27.5 | 12.6 |
| Comp. 20 | 31.2 | 38.6 | 39.6 | 38.4 | 37.6 | 37.2 | 33.2 | 32.1 | 28.5 | 27.4 | 26.4 | 13.2 |

Examp.: Example,

Comp.: Comparative example

Table 12 shows that, in the Examples of the present invention, the variation in electrostatic charge of toner was kept at 4 μC/g or less over a long period of printing from the initial phase to 200,000 prints, whereas the variation in electrostatic charge of toner exceeded 5 μc/g in the Comparative Examples. This has verified the effects of the present invention.

As described above, separation voltage is controlled in such a way as to increase the opposite polarity particle separation ratio in response to the number of prints. This provides advantages of effectively assisting the electrostatic charge of carrier by the opposite polarity particles, whereby stable electrostatic charge characteristic of the toner can be maintained for a long period of time. Thus, the deterioration of the carrier can be reduced for a long time, and a stable amount of electrostatic static charge of toner can be ensured through high-volume printing, thereby ensuring a long-term service life of the developing unit. Thus, this arrangement provides an image forming apparatus capable of producing high-quality images for a long period of time.

What is claimed is:

1. An image forming apparatus, comprising:

an image carrier:

an image forming mechanism which is adapted to form an electrostatic latent image on the image carrier; and a developing unit which is disposed facing the image carrier in a development area and is adapted to develop the electrostatic latent image formed on the image carrier, wherein the developing unit includes:

a developer tank which is adapted to store developer including toner, carrier for charging the toner and opposite polarity particles which are to be charged to an opposite polarity to a polarity of electrostatic charge of the toner;

a conveyance mechanism which is adapted to convey the toner to the development area and to collect the opposite polarity particles back into the developer tank; and a control mechanism which is adapted to control an amount of the opposite polarity particles collected back into the developer tank.

2. The image forming apparatus of claim 1, wherein the conveyance mechanism comprises:

a developer supporting member for supporting the developer supplied from the developer tank;

a separating member which is disposed facing the developer supporting member and is adapted to separate the opposite polarity particles from the developer on the developer supporting member; and an electric field forming mechanism for forming an electric field between the developer supporting member and the separating member, wherein the control mechanism controls a separation ratio of the opposite polarity particles which is to be separated from the developer on the developer supporting member.

3. The image forming apparatus of claim 2, wherein the electric field forming mechanism applies an alternating voltage to at least one of the developer supporting member and the separating member, and the control mechanism controls at least one of an amplitude, a frequency, an average voltage and a duty ratio of the alternating voltage.

4. The image forming apparatus of claim 2, wherein the control mechanism controls a distance between the developer supporting member and the separating member.

5. The image forming apparatus of claim 1, the conveyance mechanism comprises:

a developer supporting member for supporting the developer supplied from the developer tank;

a toner supporting member which is disposed facing the developer supporting member and is adapted to support thereon the toner transferred from the developer supporting member and convey the toner to the development area; and an electric field forming mechanism for forming an electric field between the developer supporting member and the toner supporting member, wherein the control mechanism controls a separation ratio of the opposite polarity particles when the toner is separated from the developer supporting member onto the toner supporting member.

6. The image forming apparatus of claim 5, wherein the electric field forming mechanism applies an alternating voltage to at least one of the developer supporting member and the toner supporting member, and the control mechanism controls at least one of an amplitude, a frequency, an average voltage and a duty ratio of the alternating voltage.

7. The image forming apparatus of claim 5, wherein the control mechanism controls a distance between the developer supporting member and the toner supporting member.

8. The image forming apparatus of claim 1, wherein the control mechanism executes control depending on an image area ratio which is a ratio of an area to which toner is attached to an area of a whole image.

9. The image forming apparatus of claim 8, wherein the control mechanism calculates the image area ratio based on an image data which is supplied to the image forming mechanism.

10. The image forming apparatus of claim 8, wherein the developing unit comprises:

a toner supply mechanism which is adapted to supply the developer tank with toner depending on a consumption of the toner in the developer, wherein the control mechanism calculates the image area ratio based on an amount of the toner supplied by the toner supply mechanism.

11. The image forming apparatus of claim 8, wherein the control mechanism controls an electric potential at a background portion on the image carrier depending on the image area ratio.

12. The image forming apparatus of claim 8, wherein the control mechanism controls a distance between the image carrier and the developing unit in the development area depending on the image area ratio.

13. The image forming apparatus of claim 1, wherein the control mechanism increases an amount of the opposite polarity particles collected back into the developer tank depending on an increase of an accumulated number of image forming.

14. The image forming apparatus of claim 13, wherein the control mechanism controls an electric potential at a background portion on the image carrier depending on an accumulated number of image forming.

15. The image forming apparatus of claim 13, wherein the control mechanism controls a distance between the image carrier and the developing unit in the development area depending on the accumulated number of image forming.

16. An image forming apparatus, comprising:

an image carrier:

an image forming mechanism which is adapted to form an electrostatic latent image on the image carrier; and a developing unit which is disposed facing the image carrier in a development area and is adapted to develop the electrostatic latent image formed on the image carrier, wherein the developing unit includes:

a developer tank which is adapted to store developer including toner, carrier for charging the toner and opposite polarity particles which are to be charged to an opposite polarity to a polarity of electrostatic charge of the toner;

a conveyance mechanism which is adapted to convey the toner to the development area and to collect the opposite polarity particles back into the developer tank; and a control mechanism which is adapted to calculate an image area ratio which is a ratio of an area to which toner is attached to an area of a whole image, and to control an amount of the opposite polarity particles collected back into the developer tank depending on the image area ratio.

17. The image forming apparatus of claim 16, wherein the conveyance mechanism comprises:

a developer supporting member for supporting the developer supplied from the developer tank;

a separating member which is disposed facing the developer supporting member and is adapted to separate the opposite polarity particles from the developer on the developer supporting member; and an electric field forming mechanism for forming an electric field between the developer supporting member and the separating member, wherein the control mechanism controls a separation ratio of the opposite polarity particles which is to be separated from the developer on the developer supporting member.

18. The image forming apparatus of claim 17, wherein the electric field forming mechanism applies an alternating voltage on at least one of the developer supporting member and the separating member, and the control mechanism controls at least one of an amplitude, a frequency, an average voltage and a duty ratio of the alternating voltage.

19. The image forming apparatus of claim 17, wherein the control mechanism controls a distance between the developer supporting member and the separating member.

20. The image forming apparatus of claim 16, wherein the conveyance mechanism comprises:

a developer supporting member for supporting the developer supplied from the developer tank;

a toner supporting member which is disposed facing the developer supporting member and is adapted to support thereon the toner transferred from the developer supporting member and convey the toner to the development area; and an electric field forming mechanism for forming an electric field between the developer supporting member and the toner supporting member, wherein the control mechanism controls a separation ratio of the opposite polarity particles when the toner is separated from the developer supporting member onto the toner supporting member.

21. The image forming apparatus of claim 20, wherein the electric field forming mechanism applies an alternating voltage on at least one of the developer supporting member and the toner supporting member, and the control mechanism controls at least one of an amplitude, a frequency, an average voltage and a duty ratio of the alternating voltage.

22. The image forming apparatus of claim 20, wherein the control mechanism controls a distance between the image carrier and the toner supporting member.

23. The image forming apparatus of claim 16, wherein the control mechanism calculates the image area ratio based on an image data which is supplied to the image forming mechanism.

24. The image forming apparatus of claim 16, wherein the developing unit comprises:

a toner supply mechanism which is adapted to supply the developer tank with toner depending on a consumption of the toner in the developer, wherein the control mechanism calculates the image area ratio based on an amount of the toner supplied by the toner supply mechanism.

25. The image forming apparatus of claim 16, wherein the control mechanism controls an electric potential at a background portion on the image carrier depending on the image area ratio.

26. The image forming apparatus of claim 16, wherein the control mechanism controls a distance between the image carrier and the developing unit in the development area depending on the image area ratio.

27. An image forming apparatus, comprising:

an image carrier:

an image forming mechanism which is adapted to form an electrostatic latent image on the image carrier; and a developing unit which is disposed facing the image carrier in a development area and is adapted to develop the electrostatic latent image formed on the image carrier, wherein the developing unit includes:

a developer tank which is adapted to store developer including toner, carrier for charging the toner and opposite polarity particles which are to be charged to an opposite polarity to a polarity of electrostatic charge of the toner;

a conveyance mechanism which is adapted to convey the toner to the development area and to collect the opposite polarity particles back into the developer tank;

a counter for counting an accumulated number of image forming; and a control mechanism which is adapted to increase an amount of the opposite polarity particles to be collected back into the developer tank depending on an increase of the accumulated number counted by the counter.

28. The image forming apparatus of claim 27, wherein the conveyance mechanism comprises:

a developer supporting member for supporting the developer supplied from the developer tank;

a separating member which is disposed facing the developer supporting member and is adapted to separate the opposite polarity particles from the developer on the developer supporting member; and an electric field forming mechanism for forming an electric field between the developer supporting member and the separating member, wherein the control mechanism controls a separation ratio of the opposite polarity particles which is to be separated from the developer on the developer supporting member.

29. The image forming apparatus of claim 28, wherein the electric field forming mechanism applies an alternating voltage on at least one of the developer supporting member and the separating member, and the control mechanism controls at least one of an amplitude, a frequency, an average voltage and a duty ratio of the alternating voltage.

30. The image forming apparatus of claim 28, wherein the control mechanism controls a distance between the developer supporting member and the separating member.

31. The image forming apparatus of claim 27, wherein the conveyance mechanism comprises:

a developer supporting member for supporting the developer supplied from the developer tank;

a toner supporting member which is disposed facing the developer supporting member and is adapted to support thereon the toner transferred from the developer supporting member and convey the toner to the development area; and an electric field forming mechanism for forming an electric field between the developer supporting member and the toner supporting member, wherein the control mechanism controls a separation ratio of the opposite polarity particles when the toner is separated from the developer supporting member onto the toner supporting member.

32. The image forming apparatus of claim 31, wherein the electric field forming mechanism applies an alternating voltage on at least one of the developer supporting member and the toner supporting member, and the control mechanism controls at least one of an amplitude, a frequency, an average voltage and a duty ratio of the alternating voltage.

33. The image forming apparatus of claim 31, wherein the control mechanism controls a distance between the image carrier and the toner supporting member.

34. The image forming apparatus of claim 27, wherein the control mechanism controls an electric potential at a background portion on the image carrier depending on the accumulated number of image forming.

35. The image forming apparatus of claim 27, wherein the control mechanism controls a distance between the image carrier and the developing unit in the development area depending on the accumulated number of image forming.

* * * * *